US008083226B2

(12) United States Patent
Terada

(10) Patent No.: US 8,083,226 B2
(45) Date of Patent: Dec. 27, 2011

(54) SHEET GUIDING APPARATUS WITH AN ELECTRIC FIELD OR CHARGE INVERTING PORTION

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 252 days.

(21) Appl. No.: 12/545,056

(22) Filed: Aug. 20, 2009

(65) Prior Publication Data

US 2010/0052251 A1 Mar. 4, 2010

(30) Foreign Application Priority Data

Aug. 29, 2008 (JP) ..... 2008-221041

(51) Int. Cl.
*B65H 29/30* (2006.01)

(52) U.S. Cl. ..... 271/193; 271/297; 271/69; 271/310; 271/185; 271/188; 271/198; 271/900; 271/901; 198/350; 198/370.13; 198/381

(58) Field of Classification Search ..... 271/193, 271/297, 69, 307, 310, 184, 185, 188, 198, 271/900, 901; 198/350, 370.13, 381
See application file for complete search history.

(56) References Cited

U.S. PATENT DOCUMENTS 2,660,318 A * 11/1953 Watson ..... 271/193
2,814,398 A * 11/1957 Coleman et al. ..... 198/370.13
4,618,052 A * 10/1986 Rickett et al. ..... 198/370.13
6,295,081 B1 9/2001 Kashima et al.
6,443,449 B1 9/2002 Takagi et al.
6,478,298 B1 11/2002 Mandel
7,259,955 B2 8/2007 Poh
7,496,326 B2 2/2009 Kawabata
2002/0027588 A1 3/2002 Kiyama
2006/0279621 A1 12/2006 Morohoshi
(Continued)

FOREIGN PATENT DOCUMENTS

JP S53-114424 A 10/1978
(Continued)

OTHER PUBLICATIONS

Japan Patent Office; Notification of Reason for Refusal in Japanese Patent Application No. 2008-221041 (counterpart to the above-captioned US Patent Application) mailed on Jun. 1, 2010.

*Primary Examiner* — Gerald McClain
(74) *Attorney, Agent, or Firm* — Baker Botts L.L.P.

(57) ABSTRACT

A sheet guiding apparatus, including: a supporting member having a supporting surface which supports a sheet; a first electrode provided in the supporting member; an electric field generating portion configured to generate an electric field between the supporting surface and the first electrode; a guide member which is distant from the supporting surface by a predetermined distance in a direction perpendicular to the supporting surface; a moving portion configured to move the sheet supported by the supporting surface by moving at least one of the supporting member and the guide member relatively to each other in a direction parallel to the supporting surface; and an electric field inverting portion configured to invert a direction of the electric field generated by the electric field generating portion, when a leading end portion of the sheet in a direction in which the sheet is moved has reached a vicinity of the guide member.

22 Claims, 13 Drawing Sheets

U.S. PATENT DOCUMENTS

2010/0021219 A1 1/2010 Hori

FOREIGN PATENT DOCUMENTS

| | | | |
|---|---|---|---|
| JP | H08-324876 | A | 12/1996 |
| JP | H10-303287 | A | 11/1998 |
| JP | H11-228013 | A | 8/1999 |
| JP | 2001-077186 | A | 3/2001 |
| JP | 2002-137866 | A | 5/2002 |
| JP | 2002-154711 | A | 5/2002 |
| JP | 2004-120921 | A | 4/2004 |
| JP | 2005-015227 | A | 1/2005 |
| JP | 2006-027771 | A | 2/2006 |
| JP | 2006-176261 | A | 7/2006 |
| JP | 2006-213415 | A | 8/2006 |
| JP | 2006-225085 | A | 8/2006 |
| JP | 2008-156049 | A | 7/2008 |

* cited by examiner

SHEET GUIDING APPARATUS WITH AN ELECTRIC FIELD OR CHARGE INVERTING PORTION

CROSS REFERENCE TO RELATED APPLICATION

The present application claims priority from Japanese Patent Application No. 2008-221041, which was filed on Aug. 29, 2008, the disclosure of which is herein incorporated by reference in its entirety.

BACKGROUND OF THE INVENTION

1. Field of the Invention

The present invention relates to a sheet guiding apparatus configured to guide to a predetermined position a sheet adsorbed to a supporting surface.

2. Description of the Related Art

There is conventionally known a sheet sorting apparatus configured to guide a sheet fed along a feeding path to another path branched from the feeding path. Such an apparatus is, for example, disposed on a sheet-discharged portion of a sheet-discharge device of a printer and is used as a sorter which sorts a plurality sets of recorded sheets onto a plurality of sheet-discharge trays. Such a sorter is disclosed in Patent Document 1 (U.S. Pat. No. 6,295,081 B1 and U.S. Pat. No. 6,443,449 B1 corresponding to JP-A-11-228013), Patent Document 2 (JP-A-08-324876), and Patent Document 3 (U.S. Pat. No. 6,478,298 B1 corresponding to JP-A-2002-137866).

Each of the apparatuses disclosed in Patent Documents 1 and 2 includes a flap provided in a feeding path and a solenoid for driving the flap. In each apparatus, when the flap is operated by the solenoid, a sheet is moved or enters into one of paths guided by the flap. Further, an apparatus disclosed in Patent Document 3 is provided with a gate for guiding a sheet to a desired one of paths only when the sheet is reversely fed. In this apparatus, a direction in which the sheet passed through the gate is fed is inverted, whereby the sheet is guided to the desired path.

However, in each apparatus disclosed in Patent Documents 1 and 2, the solenoid for operating the flap is needed in order to sort the sheet, resulting in that the apparatus cannot achieve downsizing and weight reduction. Further, in the apparatus disclosed in Patent Document 3, a next sheet cannot be moved into during the reverse feeding of the sheet though the solenoid is not needed. Thus, a distance between a preceding sheet and the next sheet unfortunately becomes relatively large, and thus a sheet feeding processing cannot become faster.

Each of Patent Document 4 (US 2006/0279621 A1 corresponding to JP-A-2005-15227), Patent Document 5 (JP-A-53-114424), and Patent Document 6 (U.S. Pat. No. 7,259,955 B2 corresponding to JP-A-2004-120921) discloses sheet feeding apparatus using static electricity. In this apparatus, the static electricity is generated between a sheet and a supporting member formed by a component such as a sheet feeding belt and a sheet supplying rotatable member, and the sheet is fed while being adsorbed to the supporting member by the attractive force (a coulomb force) due to the static electricity. The apparatus disclosed in Patent Document 4 is configured such that a direction in which the sheet adsorbed to the sheet feeding belt is fed is changed by a driven roller provided on a downstream side in a sheet feeding direction. Specifically, when the sheet passes through an upper surface of the driven roller, the sheet is disengaged from the sheet feeding belt by a curvature of the driven roller (actually, a curved portion of the sheet feeding belt) and stiffness of the sheet itself. The disengaged sheet is transferred to a sheet-discharge tray located on a downstream side and is moved to the sheet-discharge tray (with reference to paragraph [0050] in Patent Document 4).

However, in a mechanism in which the sheet is disengaged from the sheet feeding belt like the apparatus disclosed in Patent Document 4, the sheet can be disengaged only at a curved portion of the sheet feeding belt. In other words, the sheet cannot be disengaged at straight portion of the sheet feeding belt. Thus, where the feeding path is branched from the straight portion of the sheet feeding belt, the sheet cannot be guided to the branched path. Further, under a circumstance where a condition in which the sheet is disengaged from the sheet feeding belt is different between a case where a thin sheet having low stiffness is fed and a case where a thick sheet having high stiffness is fed, where the curvature of the driven roller has to be made larger to suit the thin sheet, a design freedom of the driven roller, the sheet feeding belt, and so on is limited. On the other hand, where the curvature of the driven roller is made smaller to suit the thick sheet, there is caused a problem in which the sheet is not disengaged from the sheet feeding belt when the thin sheet is fed. This problem may occur not only for an apparatus having a mechanism in which a sheet is supported by a sheet feeding belt but also for a general apparatus having a mechanism in which a sheet is guided to another position from a supporting surface by which the sheet is supported by an attractive force due to static electricity.

SUMMARY OF THE INVENTION

This invention has been developed in view of the above-described situations, and it is an object of the present invention to provide a sheet guiding apparatus which can realize a mechanism for guiding a sheet to a predetermined position in a simple structure without using a complicated mechanism such as a sheet-reversely-feed mechanism and a solenoid, and which can selectively disengage the sheet from a supporting surface at a desired position of a feeding path to guide the sheet to the predetermined position.

The object indicated above may be achieved according to the present invention which provides a sheet guiding apparatus, comprising: a supporting member formed of a dielectric material having a supporting surface which supports a sheet; a first electrode provided in the supporting member so as to be distant from the supporting surface; an electric field generating portion configured to generate an electric field between the supporting surface and the first electrode by applying a voltage to the first electrode; a guide member which is distant from the supporting surface by a predetermined distance in a direction perpendicular to the supporting surface and which defines a path extending to the predetermined position; a moving portion configured to move the sheet supported by the supporting surface by moving at least one of the supporting member and the guide member relatively to each other in a direction parallel to the supporting surface; and an electric field inverting portion configured to invert a direction of the electric field generated by the electric field generating portion, when a leading end portion of the sheet in a direction in which the sheet is moved has reached a vicinity of the guide member.

The object indicated above may also be achieved according to the present invention which provides a sheet guiding apparatus, comprising: a supporting member formed of a dielectric material having a supporting surface which supports a sheet; a first electrode provided in the supporting member, the portion being distant from the supporting surface; a charge generating portion configured to charge the supporting surface by applying a voltage to the first electrode; a guide member which is distant from the supporting surface by a predetermined distance in a direction perpendicular to the supporting surface and which defines a path extending to the predetermined position; a moving portion configured to move the sheet supported by the supporting surface by moving at least one of the supporting member and the guide member relatively to each other in a direction parallel to the supporting surface; and a charge inverting portion configured to invert positive and negative values of a charge generated on the supporting surface by the charge generating portion, when a leading end portion of the sheet in a direction in which the sheet is moved has reached a vicinity of the guide member.

In each of the sheet guiding apparatuses constructed as described above, the supporting member and the guide member are moved relatively to each other by the moving portion. As a result, the sheet supported by the supporting surface of the supporting member is moved toward the guide member. When the leading end of the sheet which is nearer to the guide member has reached the vicinity of the guide member, the electric field inverting portion is operated. Specifically, the direction of the electric field generated between the first electrode and the supporting surface to which the leading end portion is adsorbed is inverted by the electric field inverting portion. As a result, since a polarity of a charge generated on the supporting surface of the supporting member and a polarity of a charge generated on a surface of the sheet which faces to the supporting surface become the same, repulsion (a repulsive force) due to the static electricity acts on between the sheet and the supporting surface. The leading end portion is floated from the supporting surface due to this repulsion, so that a space is formed between the leading end portion and the supporting surface. The guide member enters into this space, whereby the leading end portion is peeled or disengaged from the supporting surface, so that the sheet passes through the path defined by the guide member to be guided to the predetermined position.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DETAILED DESCRIPTION OF THE EMBODIMENTS

Hereinafter, there will be described embodiments of the present invention by reference to the drawings. It is to be understood that the following embodiments are described only by way of example, and the invention may be otherwise embodied with various modifications without departing from the scope and spirit of the invention.

First Embodiment

There will be initially explained a first embodiment of the present invention with respect to FIGS. 1-7.

<General Construction of Sheet Guiding Apparatus 10>

Figure 1:
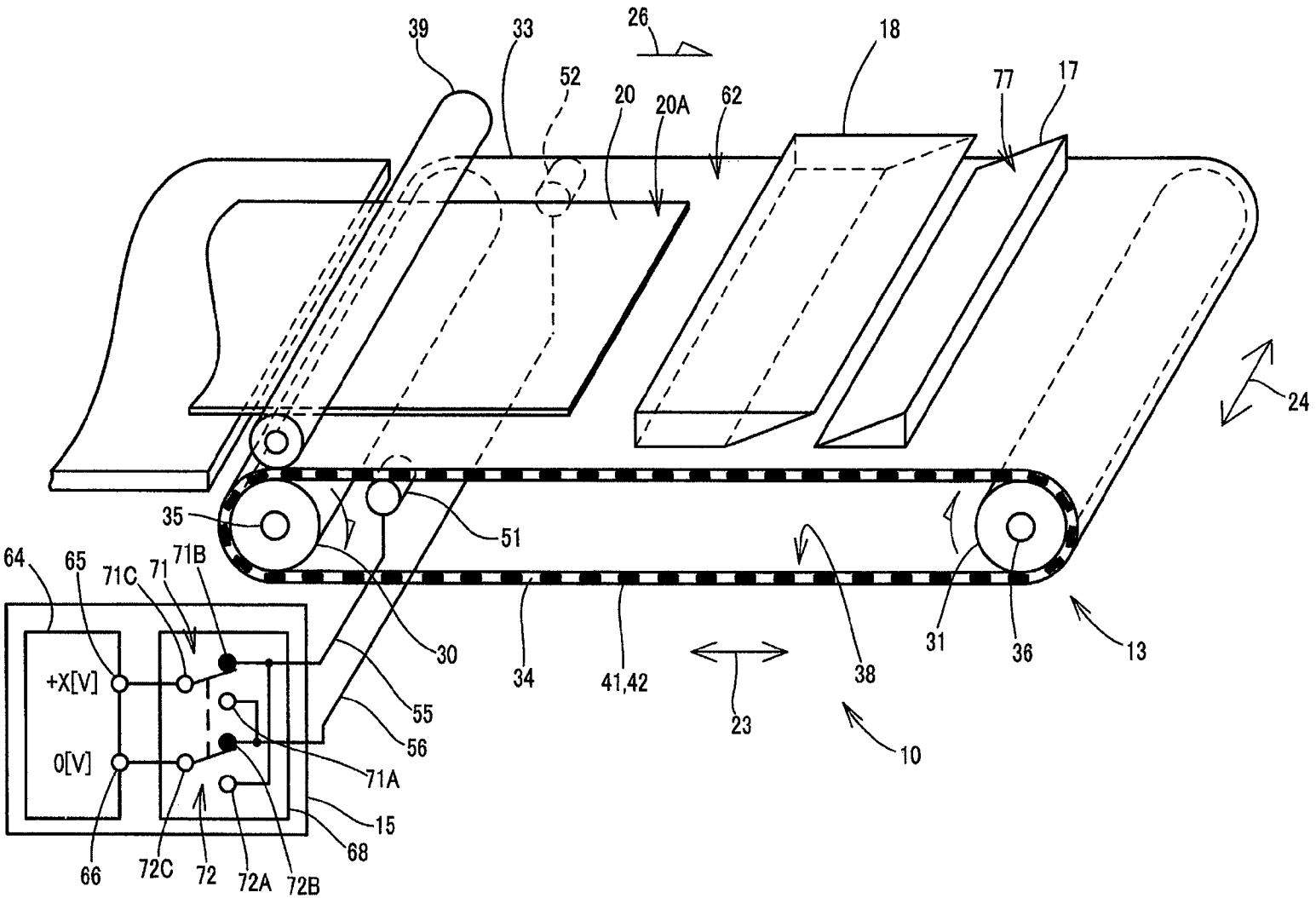
FIG. 1 is a perspective view showing an external construction of a sheet guiding apparatus 10 as a first embodiment.

A sheet guiding apparatus 10 shown in FIG. 1 is for guiding a sheet such as a recording sheet and a document to a predetermined position. This sheet guiding apparatus 10 is used for an apparatus dealing with the sheet (e.g., the recording sheet and the document) such as an image recording apparatus (e.g., a printer, a facsimile apparatus, and a copying machine), a sheet sorting apparatus for sorting a recorded sheet on which an image is recorded by the image recording apparatus, and a document feeding apparatus for feeding the document in the copying machine and a scanner. This sheet guiding apparatus 10 is mainly used for switching a feeding path during sheet feeding.

The sheet guiding apparatus 10 as the present embodiment is for guiding a sheet 20 to the predetermined position by utilizing a phenomenon in which the sheet 20 is floated from a sheet supporting surface 62 by repulsion due to static electricity. As shown in FIG. 1, the sheet guiding apparatus 10 mainly includes a belt driving device (a moving portion) 13, a power-source controller (an electric field inverting portion, a charge inverting portion) 15, and a sheet guide (a guide member) 17. Hereinafter, there will be explained components or elements of the sheet guiding apparatus 10, a floating phenomenon of the sheet 20, and a guiding operation of the sheet 20. It is noted that the apparatuses to each of which the sheet guiding apparatus 10 is applied are conventionally well known, and a detailed explanation of which is dispensed with.

<Belt Driving Device 13>

The belt driving device 13 includes a drive roller (a rotation supporting portion) 30, a driven roller (a rotation supporting portion) 31, a rotational belt (a supporting member) 33 as a rotatable member provided by an endless belt (i.e., a continuous surface), and a driven roller 39. This belt driving device 13 applies a drive force to the rotational belt 33 and thereby rotates the rotational belt 33 in a predetermined direction. Further, the belt driving device 13 rotates the rotational belt 33 in a state in which a constant distance (a predetermined distance) D is always kept between the sheet supporting surface 62 and the sheet guide 17 which will be described below.

The rotational belt 33 is rotatably supported by the drive roller 30 and the driven roller 31 so as to be hanged on or bridged between the drive roller 30 and the driven roller 31. A rotational shaft 35 of the drive roller 30 and a rotational shaft 36 of the driven roller 31 are supported by a frame, not shown. The rotational shaft 36 is elastically biased by an elastic member such as a spring in a direction away from the drive roller 30 (for example, in a rightward direction in FIG. 2). As a result, the rotational belt 33 is supported in a state in which the rotational belt 33 is stretched taut by a predetermined tension. It is noted that the rotational belt 33 is supported by the two rollers (i.e., the drive roller 30 and the driven roller 31) in the present embodiment, but a third roller may be provided in addition to the drive roller 30 and the driven roller 31 to support the rotational belt 33 by the three rollers, for example. Of course, the rotational belt 33 may be supported by equal to or more than four rollers.

The rotational shaft 35 of the drive roller 30 is connected or coupled to a motor, not shown. Where this motor is driven to be rotated, and a rotational drive force generated thereby is transmitted to the rotational shaft 35, the drive roller 30 is rotated in a predetermined direction (in a clockwise direction in FIG. 2 in the present embodiment). Where the drive roller 30 is rotated, the rotational belt 33 is rotated in the predetermined direction (the same as the direction in which the drive roller 30 is rotated) by a frictional force between a surface of the drive roller 30 and an inner face 38 (i.e., a face nearer to a center of the rotation) of the rotational belt 33, and further the driven roller 31 is rotated in the predetermined direction by a frictional force between the inner face 38 of the rotational belt 33 and a surface of the drive roller 31. The surface of each of the drive roller 30 and the driven roller 31 is formed by a material (e.g., a sponge and a rubber) having a relatively large frictional coefficient in order to make it possible to transmit a rotational force of each roller 30, 31 to the rotational belt 33 with a relatively small loss. It is noted that a pinion gear may be employed instead of the drive roller 30 and the driven roller 31 to provide, on the inner face 38 of the rotational belt 33, a rack meshable with the pinion gear. This construction may also cause the rotational belt 33 to be rotated.

The driven roller 39 is provided on an upper side of the drive roller 30. A rotational shaft of the driven roller 39 is supported by the frame, not shown. On the upper side of the drive roller 30, the driven roller 39 is biased as a pressing portion by an elastic material, not shown, toward the rotational belt 33 so as to be held in pressing contact with the rotational belt 33.

Figure 2:
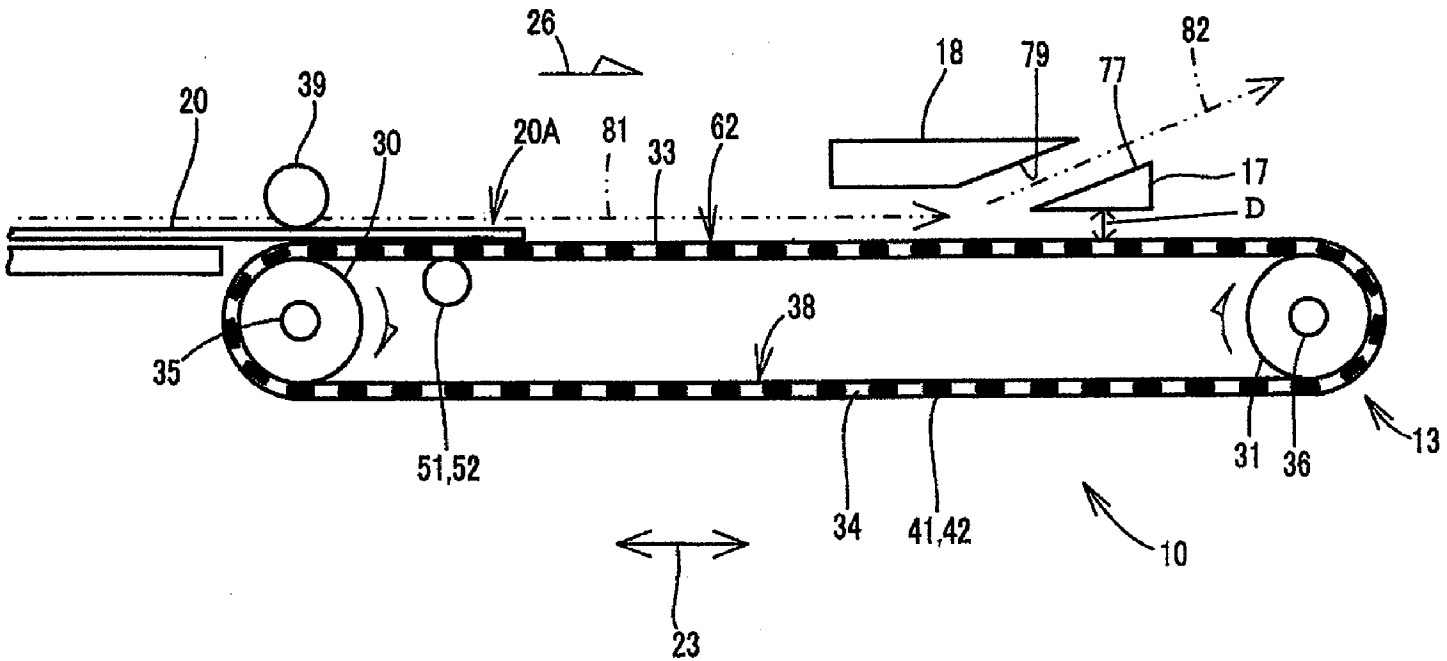
FIG. 2 is a side view of the sheet guiding apparatus 10.

The rotational belt 33 is for supporting the sheet 20 such as the recording sheet and the document by an attractive force due to the static electricity, and for feeding the sheet 20. A portion of an outer surface which faces upward in a vertical direction (on an opposite side of the center of the rotation) of the rotational belt 33 is the sheet supporting surface 62. In the present embodiment, there is formed a path 81 (with reference to FIG. 2) through which the sheet 20 can be passed along the sheet supporting surface 62. Considering that the sheet 20 is fed in a state in which the sheet 20 is adsorbed to the sheet supporting surface 62, an upper side of the sheet supporting surface 62 substantially functions as the path 81. As shown in FIGS. 1 and 2, the rotational belt 33 is provided such that the sheet supporting surface 62 is horizontal. Of course, the present invention is not limited to a case in which the sheet supporting surface 62 is horizontal. For example, the sheet supporting surface 62 may be a vertical surface and may be inclined at a predetermined angle with respect to a horizontal plane.

In view of the above, in the present embodiment, since the rotational belt 33 has the continuous supporting surface, the rotational belt 33 can continuously support a plurality of the sheets 20 when the rotational belt 33 is rotated. Further, the sheet supporting surface 62 is a horizontally straight surface so as to flatly support the sheet 20. Thus, where the sheet 20 is supported on the straight supporting surface, an action of disengagement received from a curvature surface of the rotational belt 33 is not caused in a case in which a sheet is supported on the surface having a curvature. Thus, the sheet 20 is reliably adsorbed to the sheet supporting surface 62. Consequently, a force of sheet feeding is improved.

Where the drive roller 30 is rotated in the clockwise direction in FIG. 2, the rotational belt 33 is rotated in the clockwise direction as well. Then, in accordance with the rotation of the rotational belt 33, the driven roller 39 with which the sheet supporting surface 62 is held in pressing contact is accordingly rotated. The sheet 20 is fed by a sheet feeding mechanism, not shown, in a sheet feeding direction (indicated by arrow 26 having one arrow head) from a left side in FIG. 2 toward the rotational belt 33 and enters into between the rotational belt 33 and the driven roller 39. Then, the sheet 20 is fed onto the sheet supporting surface 62 while nipped by the rotational belt 33 and the driven roller 39. Where the sheet 20 is disposed or located on the sheet supporting surface 62, and a lower surface of the sheet 20 contacts with the sheet supporting surface 62, there is applied, to the sheet 20, the attractive force due to the static electricity which is generated between the rotational belt 33 and the sheet 20 by an electric field generated by a voltage applied to electrodes 41, 42 described below, so that the sheet 20 is stuck to the sheet supporting surface 62 as if the sheet 20 is adsorbed to the sheet supporting surface 62. Where the rotational belt 33 is rotated in this state, the sheet 20 is fed in the sheet feeding direction 26 in the state in which the sheet 20 is adsorbed to the sheet supporting surface 62. It is noted that, hereinafter, a phenomenon in which the sheet 20 is stuck to the sheet supporting surface 62 as if adsorbed may be simply referred to as an "adsorption".

<Rotational Belt 33>

The rotational belt 33 is constituted by a base 34 formed of a dielectric material, and the two electrodes (first and second electrodes) 41, 42. The base 34 has a circular shape in side view. This base 34 is exposed to the outer face of the rotational belt 33. Thus, the exposed surface of the base 34 constitutes the sheet supporting surface 62. In other words, the sheet supporting surface 62 is formed of the dielectric material.

The electrodes 41, 42 are buried in the base 34 of the rotational belt 33 and covered at outer surfaces thereof with the base 34. In other words, the electrodes 41, 42 are provided on portions of the rotational belt 33 which are distant from the sheet supporting surface 62. Each of the electrodes 41, 42 is formed of a conductive material such as metal having conductivity.

Figure 3:
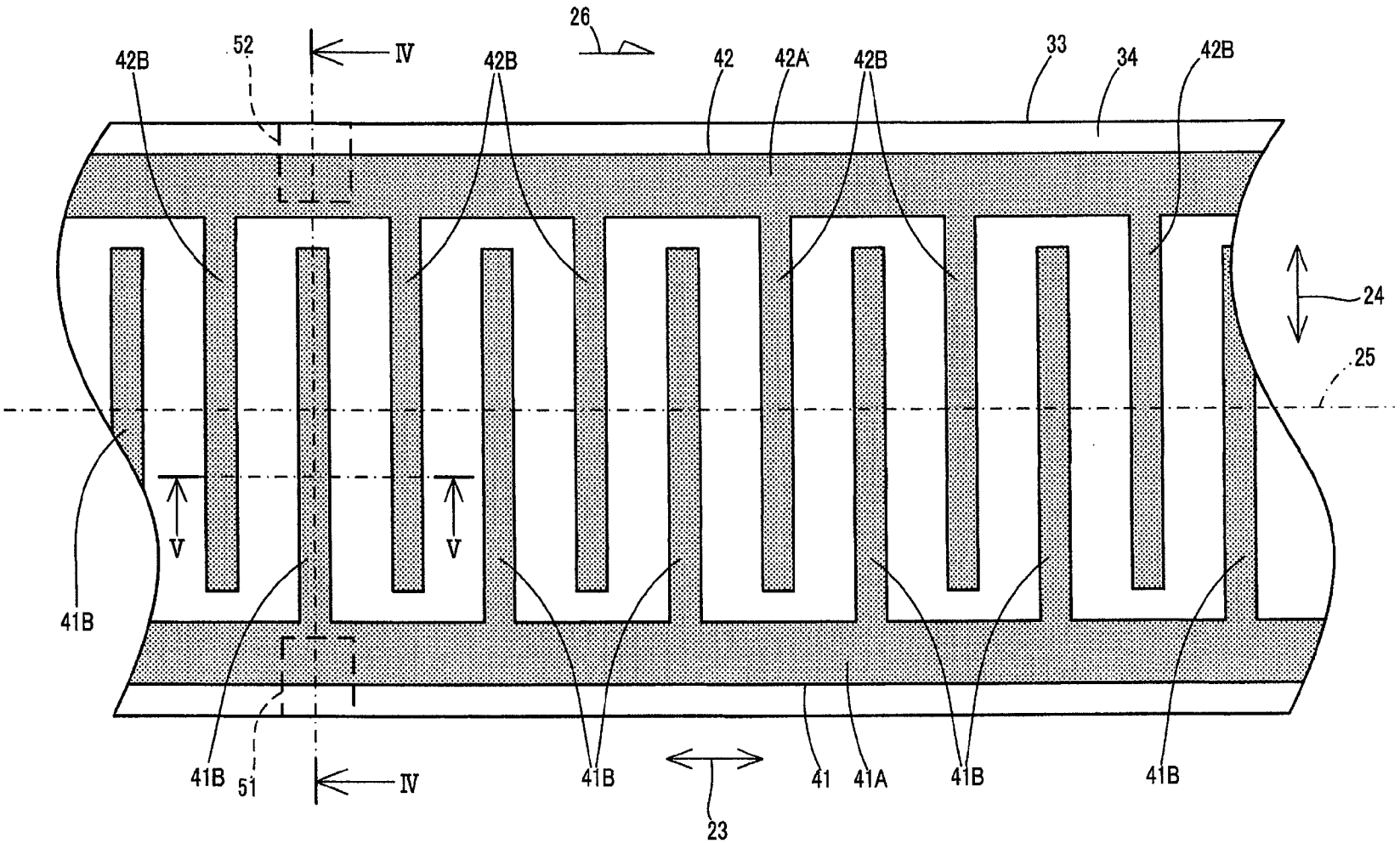
FIG. 3 is a view showing an electrode pattern of a rotational belt 33 as seen from a side of an outer face thereof.

FIG. 3 shows a pattern of the electrodes 41, 42. It is noted that FIG. 3 shows the electrodes 41, 42, but actually, the electrodes 41, 42 are buried in the base 34 and thus cannot be seen on the outer face of the rotational belt 33. The electrode 41 includes (a) a contacting (connecting) portion 41A extending in a longitudinal direction of the rotational belt 33 (which is indicated by arrow 23 having two opposite arrow heads) and (B) a plurality of branched portions 41B extending in a widthwise direction of the rotational belt 33 (which is indicated by arrow 24 having two opposite arrow heads). In other words, the plurality of branched portions 41B extend along a direction perpendicular to a direction in which the contacting portion 41A extends. To the contacting portion 41A is electrically connected an electrode roller 51 which will be described below. The contacting portion 41A is disposed at one of opposite end portions of the rotational belt 33 in the widthwise direction 24. The contacting portion 41A has a circular shape in side view like the base 34. As shown in FIG. 4, the contacting portion 41A is exposed to the inner face 38 of the rotational belt 33. The branched portions 41B are branched from the contacting portion 41A and extend in the widthwise direction 24. An end of each of the branched portions 41B which is further from the contacting portion 41A reaches a vicinity of the other of the opposite end portions of the rotational belt 33 in the widthwise direction 24. The plurality of branched portions 41B are disposed in the longitudinal direction 23 so as to be spaced from each other at regular intervals.

Like the electrode 41, the electrode 42 includes a contacting (connecting) portion 42A and a plurality of branched portions 42B. That is, the plurality of branched portions 42B extend along a direction perpendicular to a direction in which the contacting portion 42A extends. More specifically, the plurality of branched portions 42B extend in an opposite direction to the direction in which the plurality of branched portions 41B extend. To the contacting portion 42A is electrically connected an electrode roller 52 which will be described below. With reference to FIG. 4, the contacting portion 42A is exposed to the inner face 38 of the rotational belt 33. The electrode 42 and the electrode 41 are electrically insulated from each other. The electrode 42 and the electrode 41 are offset symmetrical with each other with respect to a central line 25 passing through a center of the rotational belt 33 in the widthwise direction thereof. As shown in FIG. 3, each of the plurality of branched portions 42B of the electrode 42 are disposed between corresponding adjacent two of the plurality of branched portions 41B of the electrode 41. In the present embodiment, the branched portions 41B and the branched portions 42B are alternately disposed in the longitudinal direction 23 so as to be spaced from each other at a predetermined distance.

The electrode roller 51 and the electrode roller 52 are provided on an inner side of the rotational belt 33. The electrode rollers 51, 52 are respectively for apply voltages to the electrodes 41, 42. Each of the electrode rollers 51, 52 is formed of a conductive material having a tubular shape or a circular cylindrical shape. The electrode roller 51 is rotatably supported by an exposed surface 58 of the contacting portion 41A in a state in which the electrode roller 51 is held in contact with the exposed surface 58. Further, the electrode roller 52 is rotatably supported by an exposed surface 59 of the contacting portion 42A in a state in which the electrode roller 52 is held in contact with the exposed surface 59. A lead 55 drawn from the power-source controller 15 which will be described below is connected to the electrode roller 51, and a lead 56 drawn from the power-source controller 15 is connected to the electrode roller 52. The lead 55 is electrically connected to the electrode roller 51 via, e.g., a brush for example. As a result, it is made possible to apply the voltage from the power-source controller 15 to the electrode 41 via the lead 55 and the electrode roller 51, and it is also made possible to apply the voltage to the electrode 42 via the lead 56 and the electrode roller 52.

It is noted that, in the present embodiment, the voltages are applied to the electrodes 41, 42 using the electrode rollers 51, 52, but, for example, the voltages may be applied to the electrodes 41, 42 by electrically connecting the leads 55, 56 and the respective exposed surfaces 58, 59 via the brush without using the electrode rollers 51, 52. Further, in the present embodiment, the electrode rollers 51, 52 are provided independently of the drive roller 30 and the driven roller 31, but the drive roller 30 and the driven roller 31 may double as the electrode rollers 51, 52.

<Power-Source Controller 15>

The power-source controller 15 is configured to control such that predetermined voltages are respectively applied to the electrode rollers 51, 52. This power-source controller 15 includes a direct-voltage source 64 (partly constituting an electric field generating portion) and a switching portion 68. The direct-voltage source 64 applies voltages to the respective electrodes 41, 42, thereby charging the sheet supporting surface 62 with the power-source controller 15 functioning as a charge generating portion. More specifically, the direct-voltage source 64 generates an electric field between the sheet supporting surface 62 and the electrodes 41, 42 by applying the voltages to the respective electrodes 41, 42. In the present embodiment, as will be described below, the direct-voltage source 64 applies a direct voltage of X[V] to between the electrode 41 and the electrode 42, thereby causing a potential difference between the electrode 41 and the electrode 42. This direct-voltage source 64 is, for example, a battery or a rectification circuit configured to rectify an alternating voltage inputted from an outside to convert the alternating voltage to the direct voltage. The direct-voltage source 64 includes (a) a terminal 66 whose voltage is kept at a reference voltage 0[V] (normally, at a voltage at a position at which the terminal 66 is grounded) and (b) a terminal 65 whose voltage is kept at a direct voltage of +X[V] with respect to the reference voltage 0[V].

The switching portion 68 is for switching or inverting the respective voltages applied to the electrode 41 and the electrode 42 by the direct-voltage source 64. This switching portion 68 includes two switches 71, 72. Each of the switches 71, 72 can be constituted by a components such as a transistor and a relay contact. Each of the switches 71, 72 includes two outputting contacts. Specifically, the switch 71 includes two outputting terminals 71A, 71B and a terminal 71C as a common terminal. The terminal 71C is connected to the terminal 65, the terminal 71A is connected to the lead 55, and the terminal 71B is connected to the lead 56. Further, the switch 72 includes two outputting terminals 72A, 72B and a terminal 72C as a common terminal. The terminal 72C is connected to the terminal 66, the terminal 72A is connected to the lead 56, and the terminal 72B is connected to the lead 55.

In the present embodiment, the switches 71, 72 are configured such that the respective outputting contacts thereof are associatively operated with each other by a controlling circuit, not shown, provided in the power-source controller 15. Specifically, where the switches 71, 72 are not driven by the controlling circuits, the switch 71 is kept at such a position that the terminal 71C and the terminal 71B are conducted to each other, and the switch 72 is kept at such a position that the terminal 72C and the terminal 72B are conducted to each other. In this conducting state, a potential of the electrode 41 is +X[V], and a potential of the electrode 42 is the reference voltage 0[V]. That is, the potential of the electrode 41 is higher than that of the electrode 42. On the other hand, the switches 71, 72 are operated by the controlling circuit (not shown), the switch 71 is switched to a position at which the terminal 71C and the terminal 71A are conducted to each other, and the switch 72 is switched to a position at which the terminal 72C and the terminal 72A are conducted to each other. In this state, the potential of the electrode 41 is the reference voltage 0[V], and the potential of the electrode 42 is +X[V]. That is, the potential of the electrode 41 is lower than that of the electrode 42. Thus, the polarity of the charges can be inverted by a simple structure.

<Sheet Guide 17>

As shown in FIGS. 1 and 2, the sheet guide 17 is for guiding to the predetermined position the sheet 20 fed by the rotational belt 33 while peeling the sheet 20 from the sheet supporting surface 62. The sheet guide 17 is provided above the sheet supporting surface 62 of the rotational belt 33. This sheet guide 17 is fixed to the frame, not shown. Of course, the sheet guide 17 may be constructed integrally with the frame.

The sheet guide 17 is disposed at a position distant from the sheet supporting surface 62 by the distance D. The sheet guide 17 has a guide surface 77 inclined with respect to the sheet supporting surface 62. The distance D is set to a dimension in which a leading end portion 20A of the sheet 20 can be moved onto the guide surface 77 when the leading end portion 20A of the sheet 20 is floated by the repulsion due to the static electricity as will be described below. It is noted that this distance D is determined on the basis of factors such as a dielectric constant of the base 34, a type (e.g., thickness, weight, and material) of the sheet 20 capable of being fed by the rotational belt 33, an angle of the sheet supporting surface 62 with respect to the horizontal plane where the sheet supporting surface 62 is not horizontal.

With respect to two-dot chain line in FIG. 2, a path (a branched path) 82 is formed so as to be continuous to the guide surface 77. The path 82 is for guiding the sheet 20 to the predetermined position. As shown in FIG. 2, the path 82 is branched from the path 81 at a position (i.e., a branch point) located on a slightly upstream side of the sheet guide 17 in the sheet feeding direction 26 so as to extend obliquely upward with respect to the sheet supporting surface 62. In other words, the path 82 is branched from the branch point set on the path 81. The sheet feeding mechanism (not shown) configured to feed the sheet 20 guided by the sheet guide 17 may be provided on the path 82.

An auxiliary guide 18 is provided at a position facing to the guide surface 77. The auxiliary guide 18 is provided above the sheet supporting surface 62 like the sheet guide 17. A space through which the sheet 20 can pass is formed between the auxiliary guide 18 and the sheet supporting surface 62. The auxiliary guide 18 has a facing surface 79 facing to the guide surface 77. A space through which at least the sheet 20 can pass is formed between the guide surface 77 and the facing surface 79. The path 82 may be continuous to this space. In the present embodiment, the sheet guiding apparatus 10 is operated such that the sheet 20 is guided to the space formed between the guide surface 77 and the facing surface 79 by using the floating phenomenon of the sheet 20 which will be described below.

<Floating Phenomenon of Sheet 20>

Figure 4A:
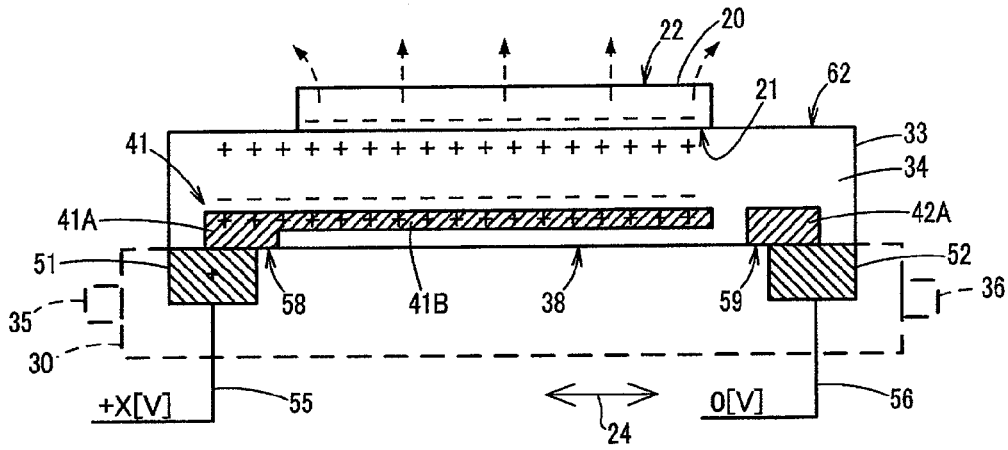
FIGS. 4A, 4B, and 4C are cross-sectional views each taken along line IV-IV of FIG. 3.
Figure 4B:
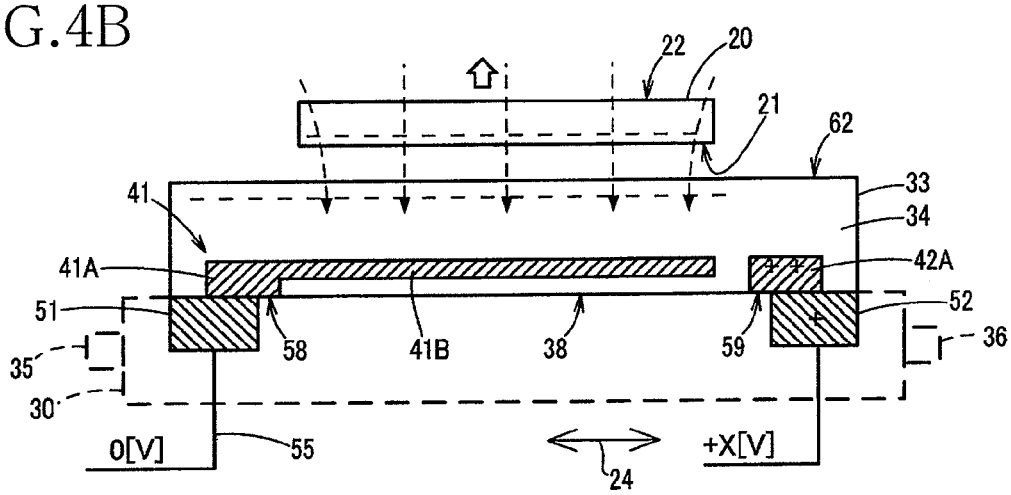
Figure 4C:
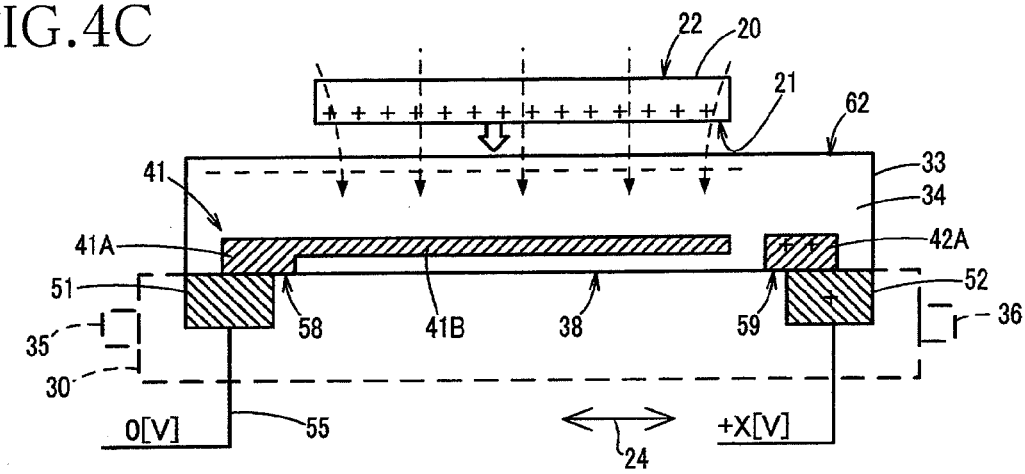
Figure 5A:
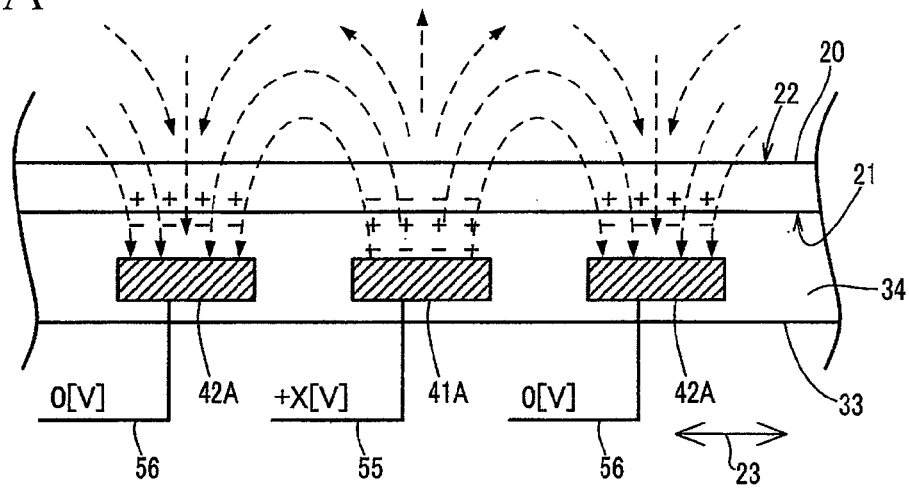
FIGS. 5A, 5B, and 5C are cross-sectional views each taken along line V-V of FIG. 3.
Figure 5B:
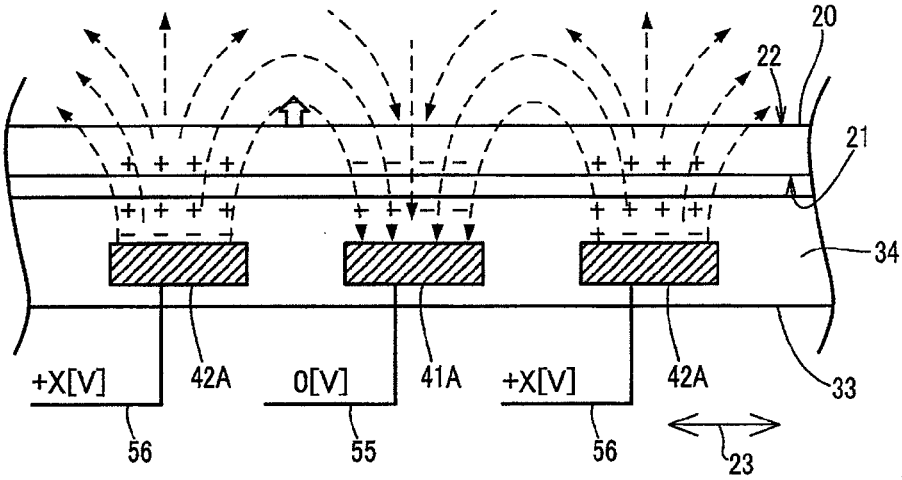
Figure 5C:
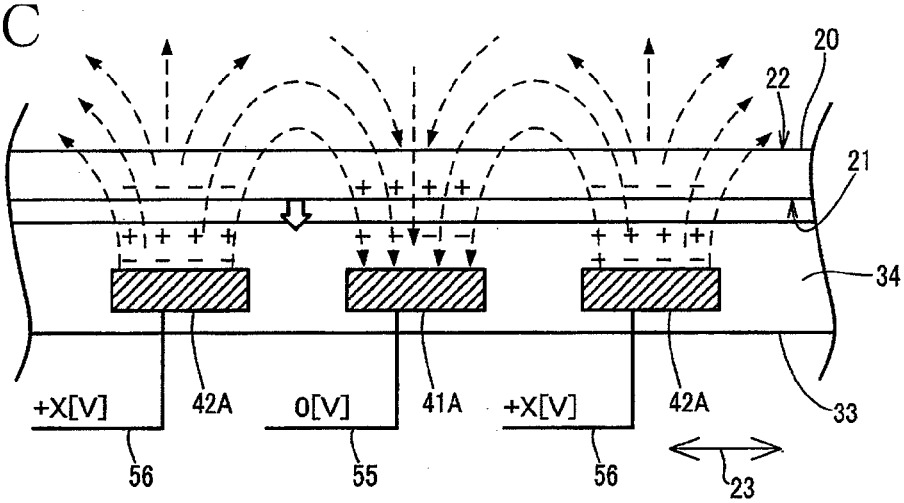

Hereinafter, there will be explained the floating phenomenon of the sheet 20 with reference to FIGS. 4 and 5. FIG. 4A shows a state in which the sheet 20 is adsorbed to the sheet supporting surface 62. FIG. 4B shows a state in which the sheet 20 is floated from the sheet supporting surface 62. FIG. 4C shows a state in which the sheet 20 is pulled toward the sheet supporting surface 62. It is noted that, in FIGS. 4A-4C, a thickness between the branched portions 41B and the sheet supporting surface 62 is shown to be excessively large for easier understanding purposes. Further, FIG. 5A shows a direction of the electric field when the voltage of +X[V] is applied to the electrode 41, and FIGS. 5B and 5C show a direction of the electric field when the voltage of +X[V] is applied to the electrode 42. It is noted that, in FIGS. 5A-5C, an electric flux line emerged from a lower surface of each of the electrodes 41, 42.

As shown in FIG. 4A, the voltage of +X[V] is applied to the electrode 41, and the voltage of the reference voltage 0[V] is applied to the electrode 42. In this time, an electric field traveling in a direction from the electrode 41 toward the electrode 42 (i.e., in a direction indicated by broken-line arrows in FIG. 5A) is generated between the electrode 41 and the electrode 42. Each broken line shown in FIG. 5 is an electric flux line of the electric field generated between the electrode 41 and the electrode 42, and each arrow indicates a direction of the electric field. Where the electric field is generated, negative charges (polarization charges) are generated or developed at portions of the base 34 formed of the dielectric material which portions are nearer to the electrode 41, and positive charges (polarization charges) are generated at a side of the sheet supporting surface 62 further from the electrode 41 by the charge polarization. Further, negative charges (polarization charges) are generated at a side of the sheet supporting surface 62 further from the electrode 42. It is noted that the charge polarization is caused on the inner face 38 of the rotational belt 33 in the similar manner, so that a phenomenon which is the same as a phenomenon caused on the side of the sheet supporting surface 62 is caused. Thus, in the following explanation, an explanation about the phenomenon caused on the inner face 38 will be omitted.

Where the sheet 20 is fed to the sheet supporting surface 62 on which the positive or negative charges are generated as described above, and the sheet 20 is disposed on the sheet supporting surface 62, charges whose polarity is opposite to a polarity of the charges generated on the sheet supporting surface 62 (i.e., an opposite polarity) are generated on a facing surface 21 of the sheet 20 which faces to the sheet supporting surface 62. Specifically, as shown in FIG. 4A, the negative charges are generated on the facing surface 21 of the sheet 20 disposed on an upper side of the electrode 41. Further, as shown in FIG. 5A, the positive charges are generated on the facing surface 21 of the sheet 20 disposed on the upper side of the electrode 42. This phenomenon is caused by the charge polarization where the sheet 20 has a relatively strong property as the dielectric material. On the other hand, the phenomenon is caused by electrostatic induction where the sheet 20 has a relatively strong property as the conductive material. As a result, the attractive force due to the static electricity is generated between the sheet supporting surface 62 and the sheet 20, so that the sheet 20 is adsorbed to the sheet supporting surface 62. It is noted that, in general, the sheet used in the image recording apparatus such as the printer, the facsimile apparatus, and the copying machine tends to have a relatively strong property as the dielectric material. The sheet guiding apparatus 10 as the present embodiment is preferably applied to the sheet made of the dielectric material.

In the present embodiment, the charges are temporarily generated also on an upper surface 22 of the sheet 20 which is opposite to the facing surface 21. Specifically, the charges whose polarity is opposite to that of the charges generated on the facing surface 21 are generated. However, the charges generated on the upper surface 22 are canceled by charges adjacent thereto having the opposite polarity and vice versa, so that the charges generated on the upper surface 22 gradually disappear. It is noted that the charges generated on the facing surface 21 of the sheet 20 and the charges generated on the sheet supporting surface 62 are pulled from each other by a force of the static electricity generated between the charges generated on the facing surface 21 and the sheet supporting surface 62. Thus, while the sheet 20 is adsorbed to the sheet supporting surface 62, the charges generated on the facing surface 21 are not canceled by charges adjacent thereto, and thus stably remained.

There will be next contemplated a case in which the voltages are changed from the state shown in FIG. 4A to the state shown in FIG. 4B, that is, a case in which, as shown in FIGS. 4B and 5B, the voltage applied to the electrode 41 is changed from +X[V] to 0[V] while the voltage applied to the electrode 42 is changed from 0[V] to +X[V]. In this case, as shown in FIG. 5B, the electric field in a direction from the electrode 42 to the electrode 41 (i.e., a direction indicated by broken-line arrows in FIG. 5B) is generated between the electrode 41 and the electrode 42. Where this electric field is generated, as shown in FIG. 5B, the negative charges (the polarization charges) are generated at portions of the base 34 formed of the dielectric material which portions are nearer to the electrode 42, and the positive charges (the polarization charges) are generated at the side of the sheet supporting surface 62 further from the electrode 42. Further, the negative charges (the polarization charges) are generated at the side of the sheet supporting surface 62 further from the electrode 41. In this time, as shown in FIGS. 4B and 5B, the polarity of the charges generated on the facing surface 21 of the sheet 20 and the polarity of the charges generated on the sheet supporting surface 62 are temporarily the same as each other. Thus, the repulsion due to the static electricity is generated between the sheet supporting surface 62 and the sheet 20, so that the sheet 20 is moved away from the sheet supporting surface 62 by the repulsion. In other words, with reference to FIGS. 4B and 5B, the sheet 20 adsorbed to the sheet supporting surface 62 is floated from the sheet supporting surface 62.

An amount of floating of the sheet 20 is determined on the basis of factors such as the dielectric constant of the base 34, the type (e.g., thickness, weight, and material) of the sheet 20 capable of being fed by the rotational belt 33, the angle of the sheet supporting surface 62 with respect to the horizontal plane where the sheet supporting surface 62 is not horizontal. In the present embodiment, the above-described distance D is set to a dimension smaller than the amount of floating of the sheet 20. In other words, the voltage +X[V] applied to the electrode 41 and the electrode 42 is a voltage value which makes it possible to cause the sheet 20 to be distant from the sheet supporting surface 62 by equal to or more than the distance D. Likewise, an intensity of the electric field generated by the voltage +X[V] and the voltage 0[V] applied to the electrode 41 and the electrode 42 is an electric field intensity which makes it possible to cause the sheet 20 to be distant from the sheet supporting surface 62 by equal to or more than the distance D. Further, an amount of the charges of the sheet supporting surface 62 generated by the voltage +X[V] and the voltage 0[V] applied to the electrode 41 and the electrode 42 is an amount of the charges which makes it possible to cause the sheet 20 to be distant from the sheet supporting surface 62 by equal to or more than the distance D.

In accordance that the distance of the sheet 20 and the sheet supporting surface 62 becomes larger owing to the floating of the sheet 20, the charges generated on the facing surface 21 of the sheet 20 temporarily disappear. This disappearance of the charges is caused by two reasons. That is, since an effect of the charges generated on the sheet supporting surface 62 is reduced because the sheet 20 is moved away from the sheet supporting surface 62, the charges generated on the facing surface 21 are canceled by the charges adjacent thereto having the opposite polarity and vice versa. Further, affected by charges newly generated on the sheet supporting surface 62, the charges temporarily disappear, which charges are generated on the facing surface 21 in a process in which the sheet 20 is subjected to the charge polarization or the electrostatic induction. Thus, there is no need to provide an electricity eliminating apparatus for eliminating the static electricity from the sheet guided to the predetermined position.

The sheet 20 floated from the sheet supporting surface 62 is again subjected to the charge polarization or the electrostatic induction by affected by the charges generated on the sheet supporting surface 62. As a result, with reference to FIGS. 4C and 5C, charges whose polarity is opposite to that of the charges generated on the facing surface 21 so far are generated on the facing surface 21. That is, the charges whose polarity is opposite to that of the charges generated on the sheet supporting surface 62 are generated on the facing surface 21. As a result, as shown in FIGS. 4C and 5C, the attractive force due to the static electricity is generated again between the sheet supporting surface 62 and the sheet 20, so that the sheet 20 is adsorbed again to the sheet supporting surface 62.

It is noted that, in the present embodiment, the branched portions 41B of the electrode 41 and the branched portions 42B of the electrode 42 are alternately disposed in the longitudinal direction 23 of the rotational belt 33. Thus, the polarities of the charges generated on the sheet 20 by the electrode 41 and the electrode 42 are alternately generated in the sheet feeding direction 26 of the sheet 20. Even where the sheet 20 is guided to the path 82 in a state in which the sheet 20 is distant from the sheet supporting surface 62 as will be described below, the polarization charges exist while being generated on the surface of the sheet 20 where the sheet 20 is made of the dielectric material. However, since the adjacent electrodes respectively hold the charges having the opposite polarities, the charges are canceled to each other between the electrodes adjacent to each other, and then the polarization charges disappear from the surface of the sheet 20 in a relatively short time.

<Guiding Operation of Sheet 20>

Figure 6A:
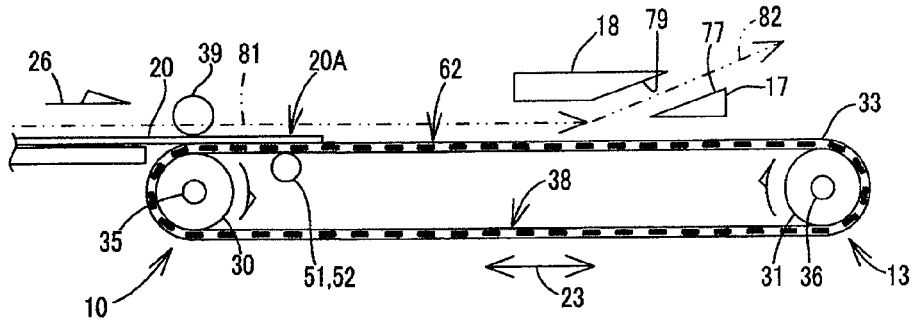
FIGS. 6A, 6B, 6C, 6D, and 6E are views each for explaining an operation in which a sheet 20 is guided.
Figure 6B:
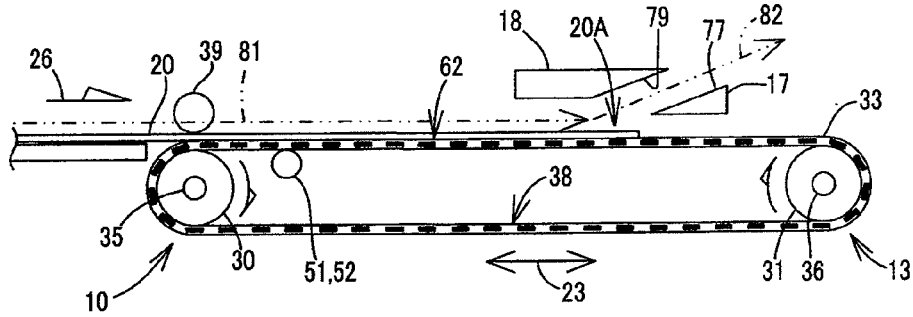
Figure 6C:
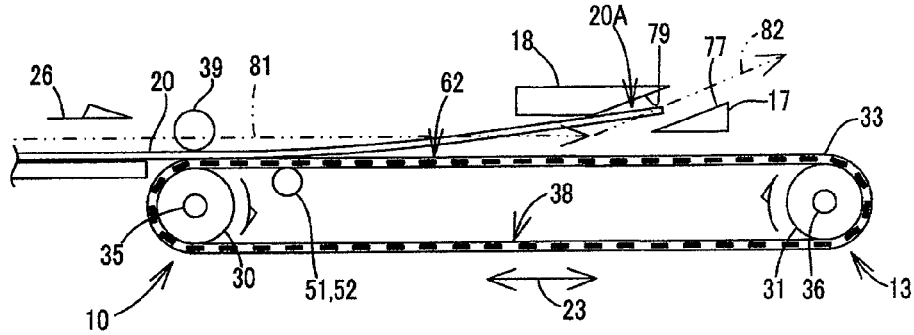
Figure 6D:
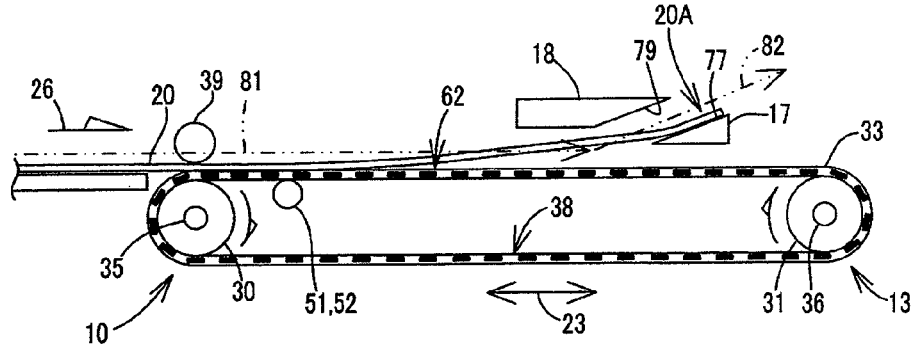
Figure 6E:
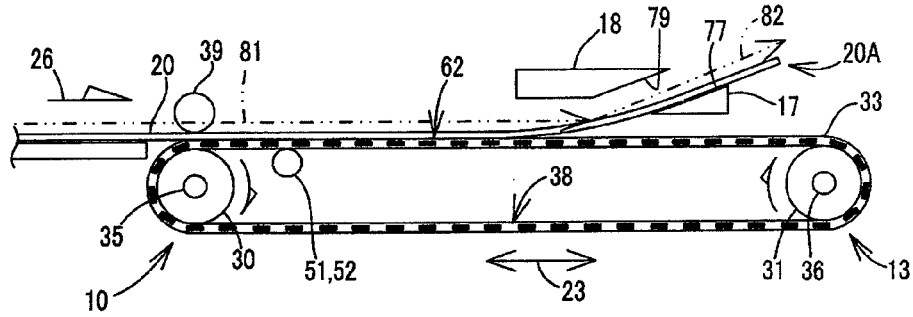

Hereinafter, there will be explained, with reference to FIG. 6, an operation in which the sheet 20 is guided by the sheet guide 17. FIG. 6A shows a state in which the sheet 20 is adsorbed to the sheet supporting surface 62. FIG. 6B shows a state in which the leading end portion 20A of the sheet 20 has reached the position (i.e., the branch point) located on the slightly upstream side of the sheet guide 17. FIG. 6C shows a state in which the sheet 20 having been contacting with the sheet supporting surface 62 is floated. FIG. 6D shows a state in which the leading end portion 20A of the sheet 20 is moved onto the guide surface 77. FIG. 6E shows a state in which the leading end portion 20A of the sheet 20 is guided by the guide surface 77. It is noted that, in FIG. 6A, there is assumed for easier understanding purposes that the switch 71 is kept at its position at which the terminal 71C and the terminal 71B are conducted to each other and kept at its position at which the terminal 72C and the terminal 72B are conducted to each other (that is, the voltage +X[V] is applied to the electrode 41, and the reference voltage 0[V] is applied to the electrode 42).

As shown in FIG. 6A, where the sheet 20 is fed by the sheet feeding mechanism (not shown), and the leading end portion 20A is disposed on the sheet supporting surface 62, a portion of the leading end portion 20A which contacts with the sheet supporting surface 62 is adsorbed to the sheet supporting surface 62. Then, the sheet 20 is fed toward the sheet feeding direction 26 (in a rightward direction in FIGS. 6A-6E) by the sheet feeding mechanism and the rotational belt 33.

In the present embodiment, as shown in FIG. 6B, when the leading end portion 20A has reached the position located on the slightly upstream side of the sheet guide 17, the outputting contacts of each of the switches 71, 72 of the switching portion 68 are switched by the controlling circuit, not shown, provided in the power-source controller 15. Specifically, the switches 71, 72 are operated by the controlling circuit, whereby the switch 71 is switched at the position at which the terminal 71C and the terminal 71A are conducted to each other, and the switch 72 is switched to the position at which the terminal 72C and the terminal 72A are conducted to each other. In this state, the voltage +X[V] is applied to the electrode 42, and the reference voltage 0[V] is applied to the electrode 41. As a result, the polarity of the charges generated on the sheet supporting surface 62 is inverted. In this case, needless to say, there is inverted a polarity of charges generated on a portion of the sheet supporting surface 62 to which the leading end portion 20A of the sheet 20 is adsorbed. Consequently, as shown in FIG. 6C, not only the leading end portion 20A of the sheet 20 but also a contacting portion of the sheet 20 which contacts with the sheet supporting surface 62 is temporarily floated from the sheet supporting surface 62. However, as shown in FIG. 6C, an end portion (i.e., a trailing end portion) of the sheet 20 which is opposite to the leading end portion 20A is located on a downstream side of the driven roller 39 (i.e., on a left side in FIGS. 6A-6E), and thus the sheet 20 is likely to be floated from the sheet supporting surface 62, but the floating of the sheet 20 is restrained by the driven roller 39. Thus, as shown in FIG. 6C, the leading end portion 20A of the sheet 20 is floated to a position furthest from the sheet supporting surface 62. It is noted that whether the leading end portion 20A has reached the position located on the slightly upstream side of the sheet guide 17 or not can be judged on the basis of an output value of, e.g., a sheet detecting sensor disposed above the sheet supporting surface 62 and a rotary encoder provided on the rotational shaft 35 of the drive roller 30.

Where the sheet 20 is fed in a state in which the leading end portion 20A is floated, as shown in FIG. 6D, the leading end portion 20A is moved onto the guide surface 77 of the sheet guide 17 and guided to the path 82 along the guide surface 77.

Then, after a period of time, the attractive force due to the static electricity is generated between the sheet 20 and the sheet supporting surface 62, the sheet 20 is adsorbed again to the sheet supporting surface 62. However, since the leading end portion 20A is supported while being located on the guide surface 77, even where the sheet 20 is fed in a state in which the sheet 20 is adsorbed to the sheet supporting surface 62, the sheet 20 is peeled from the sheet supporting surface 62 by the sheet guide 17. Then, the sheet 20 is guided toward the path 82 along the guide surface 77 while being gradually peeled by the sheet guide 17. It is noted that, in the above-described embodiment, since the floating of the sheet 20 is restrained by the driven roller 39, it is made possible to reliably float the leading end portion 20A of the sheet 20, thereby reliably guiding the leading end portion 20A of the sheet 20 to the path 82 of the sheet guide 17. Further, in the above-described embodiment, since the sheet 20 is adsorbed to the sheet supporting surface 62 in a state in which the sheet 20 is guided by the sheet guide 17, the sheet 20 can be reliably moved to be guided to the path 82 of the sheet guide 17.

Figure 7:
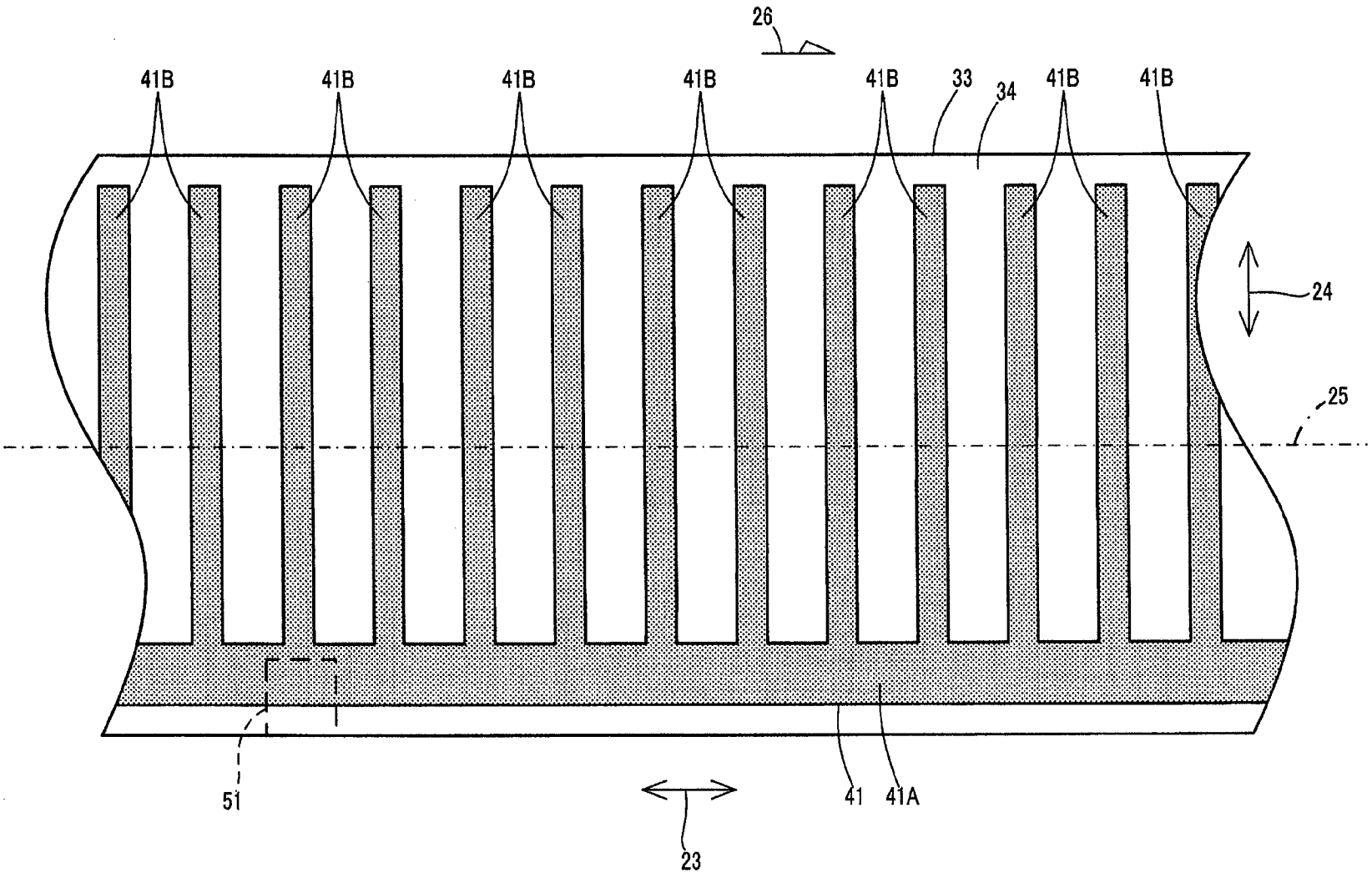
FIG. 7 is a view showing a modification of an electrode pattern of the rotational belt 33 as seen from the side of the outer face thereof.

It is noted that, in the above-described first embodiment, the electrode 41 and the electrode 42 are provided in the rotational belt 33, but, as shown in FIG. 7, only the electrode 41 may be provided in the rotational belt 33 by excluding the electrode 42 and the electrode roller 52, for example. In this case, the power-source controller 15 applies a voltage of +X[V] with respect to a ground potential to the electrode 41, and when the leading end portion 20A of the sheet 20 has reached the position located on the slightly upstream side of the sheet guide 17, the power-source controller 15 applies a voltage of −X[V] with respect to the ground potential to the electrode 41. This configuration also permits the sheet 20 to be guided along the guide surface 77 of the sheet guide 17 in a state in which the sheet 20 is floated. It is noted that electrodes may be provided in an entire area of the rotational belt 33.

Second Embodiment

Figure 8:
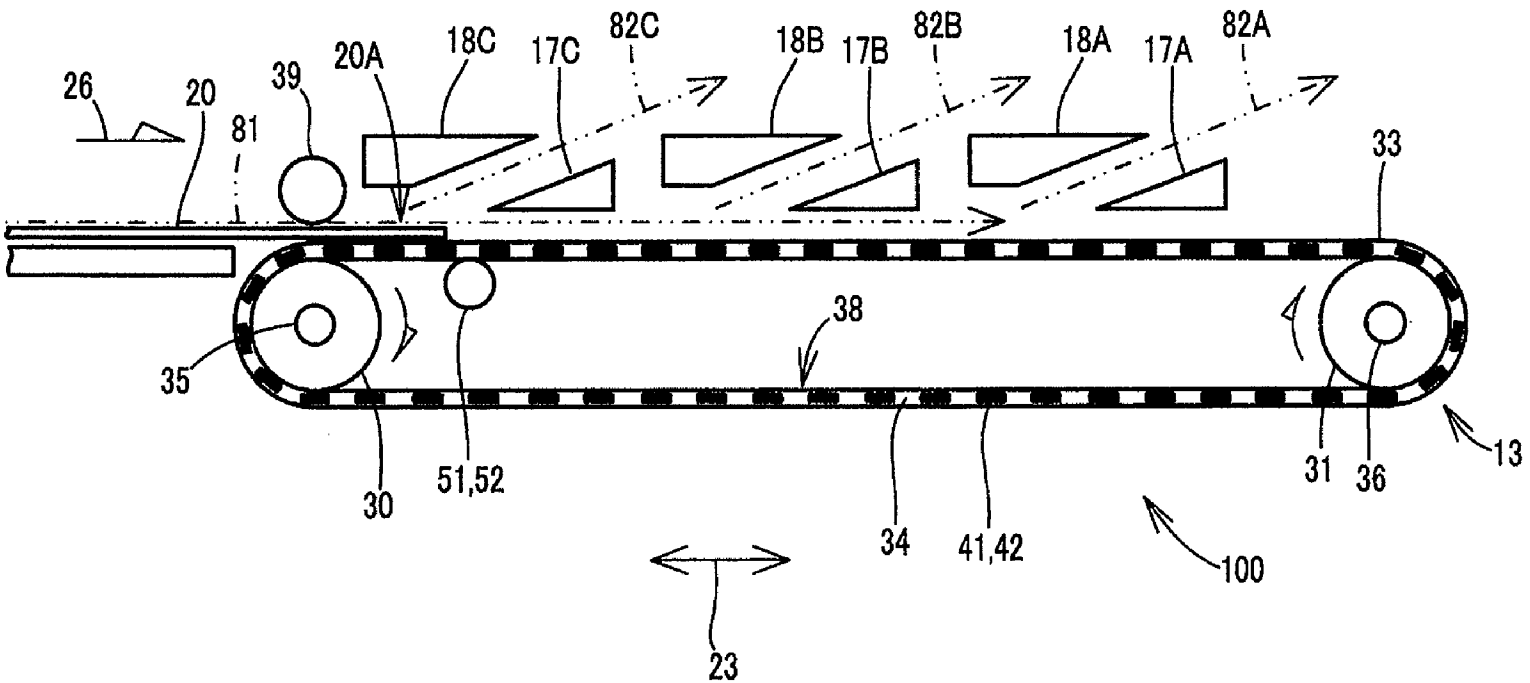
FIG. 8 is a side view of a sheet guiding apparatus 100 as a second embodiment of the present invention.

There will be next explained a second embodiment of the present invention with reference to FIG. 8. FIG. 8 is a side view of a sheet guiding apparatus 100 as a second embodiment of the present invention. FIG. 8 shows a plurality of paths (82A, 82B, 82C).

The sheet guiding apparatus 100 as the second embodiment is different from the sheet guiding apparatus 10 as the above-described first embodiment in a point that the sheet guiding apparatus 100 includes the plurality of paths 82A, 82B, 82C. It is noted that since the other configuration of the sheet guiding apparatus 100 is identical with that of the sheet guiding apparatus 10 as the above-described first embodiment, only the difference is explained here, and an explanation of the other configuration is omitted by using the same reference numerals as used in the first embodiment to identify the corresponding components.

As shown in FIG. 8, the paths 82A, 82B, 82C are respectively branched from a plurality of the branch points (three branch points in the present embodiment) set on the path 81. At the respective branch points are provided sheet guides 17A, 17B, 17C each having generally the same construction as the sheet guide 17. The sheet guides 17A, 17B, 17C are fixed to the frame, not shown, above the sheet supporting surface 62 of the rotational belt 33. Further, auxiliary guides 18A, 18B, 18C each having generally the same construction as the auxiliary guide 18 are respectively provided at positions facing to the respective sheet guides 17A, 17B, 17C.

In the sheet guiding apparatus 100 thus constructed, when the leading end portion 20A of the sheet 20 has reached a vicinity of any one of the sheet guides 17A, 17B, 17C, the outputting contacts of each of the switches 71, 72 of the switching portion 68 are switched by the controlling circuit, not shown, provided in the power-source controller 15. As a result, the polarity of the charges generated on the sheet supporting surface 62 and the direction of the electric field are inverted, whereby the leading end portion 20A of the sheet 20 is temporarily floated from the sheet supporting surface 62. It is noted that since a position of the leading end portion 20A can be judged on the basis of the output value of, e.g., the sheet detecting sensor disposed above the sheet supporting surface 62 and the rotary encoder provided on the rotational shaft 35 of the drive roller 30, the sheet 20 can be guided to a desired one of the paths 82A, 82B, 82C where the sheet guiding apparatus 100 is configured such that the outputting contacts of each of the switches 71, 72 of the switching portion 68 are switched when the leading end portion 20A has reached a desired one of the sheet guides 17A, 17B, 17C which corresponds to the desired one of the paths 82A, 82B, 82C.

Third Embodiment

Figure 9:
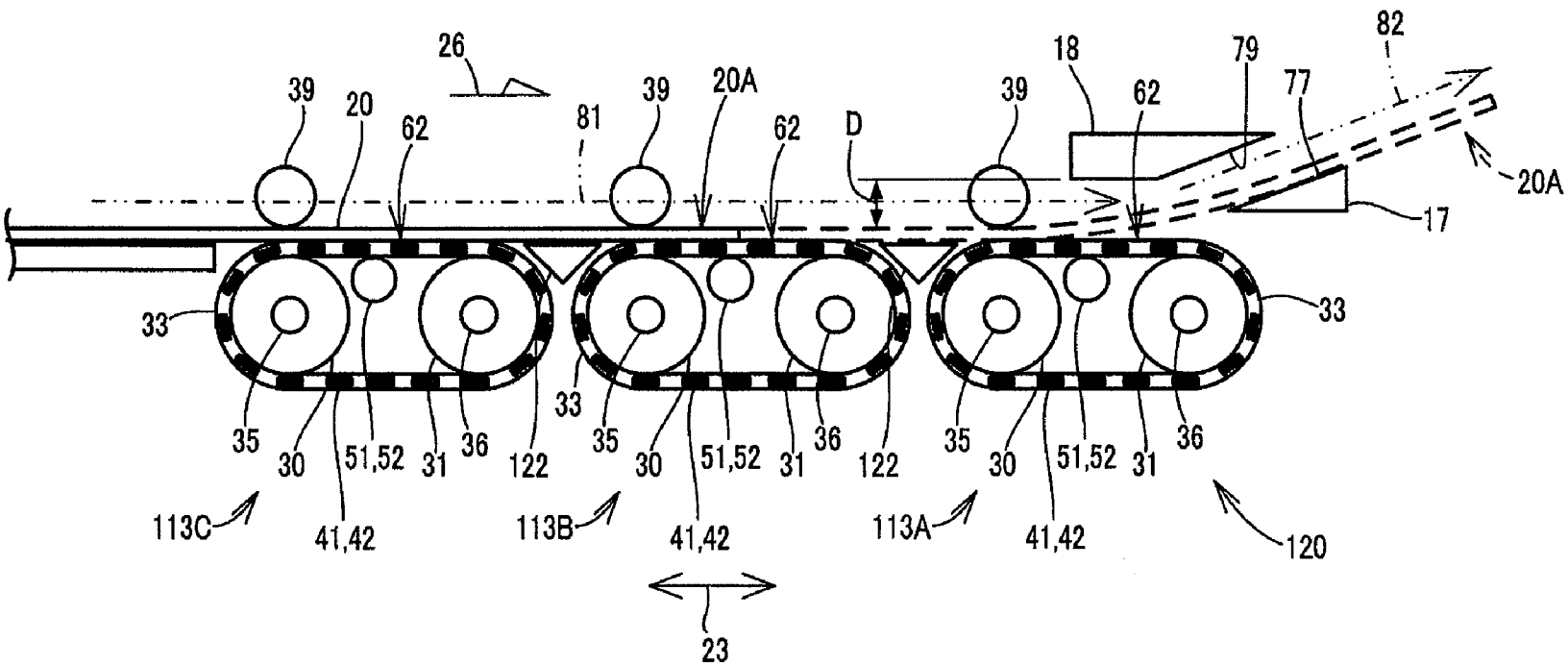
FIG. 9 is a side view of a sheet guiding apparatus 120 as a third embodiment of the present invention.

There will be next explained a third embodiment of the present invention with reference to FIG. 9. FIG. 9 is a side view of a sheet guiding apparatus 120 as a third embodiment of the present invention.

The sheet guiding apparatus 120 as the third embodiment is different from the sheet guiding apparatus 10 as the above-described first embodiment in a point that a plurality of belt driving devices 113A, 113B, 113C are provided along the path 81. It is noted that since the other configuration of the sheet guiding apparatus 120 is identical with that of the sheet guiding apparatus 10 as the above-described first embodiment, only the difference is explained here, and an explanation of the other configuration is omitted by using the same reference numerals as used in the first embodiment to identify the corresponding components.

As shown in FIG. 9, the sheet guiding apparatus 120 is provided with the plurality of the belt driving devices 113A, 113B, 113C. Each of the belt driving devices 113A, 113B, 113C has generally the same construction as the belt driving device 13 of the sheet guiding apparatus 10 as the above-described first embodiment, but is different from the sheet guiding apparatus 10 in a point that a distance between the drive roller 30 and the driven roller 31 of each of the belt driving devices 113A, 113B, 113C is excessively small compared with a length of the fed sheet 20 in the longitudinal direction 23, and each rotational belt 33 has a smaller length than the rotational belt 33 in the sheet guiding apparatus 10 as the above-described first embodiment.

Each of the belt driving devices 113A, 113B, 113C is disposed in the sheet feeding direction 26. The rotational belt 33 included in each of the belt driving devices 113A, 113B, 113C and the electrodes 41, 42 provided in the rotational belt 33 are insulated from each other. The two guides 122 each having an inverted triangle shape and for delivering the sheet 20 to a corresponding downstream one of the belt driving devices in the sheet feeding direction 26 are provided between the belt driving devices 113A, 113B and between the belt driving devices 113B, 113C. A curvature of a curved portion of each rotational belt 33 which is held in contact with the driven roller 31 is made larger, whereby the leading end portion 20A of the sheet 20 is disengaged from the rotational belt 33 at the curved portion. Each of the guides 122 supports the disengaged leading end portion 20A and guides the leading end portion 20A to the corresponding downstream belt driving device.

The electrode rollers 51, 52 are provided on an inside of each of the belt driving devices 113A, 113B, 113C. A lead connected to the power-source controller 15 is connected to each of the electrode rollers 51. Likewise, a lead connected to the power-source controller 15 is also connected to each of the electrode rollers 52. The power-source controller 15 can individually control the voltages applied to the electrode rollers 51, 52 by providing the switching portion 68 of the above-described first embodiment for each of the electrode rollers 51, 52.

Since the sheet guiding apparatus 120 as the present embodiment is thus configured, the leading end portion 20A of the sheet 20 has reached the vicinity of the sheet guide 17 (more accurately, the vicinity of the position located on the slightly upstream side of the sheet guide 17), only the voltages applied to the electrode rollers 51, 52 of the belt driving device 113A corresponded to the leading end portion 20A can be changed by the switching portion 68. Thus, only the voltages applied to the electrode rollers 51, 52 of the belt driving device 113A are changed, whereby the respective voltages of the charges generated on the sheet supporting surface 62 of the belt driving device 113A (and the direction of the electric field) are inverted. As a result, only the leading end portion 20A of the sheet 20 is temporarily floated from the sheet supporting surface 62. Then, the sheet 20 is fed in a state in which the leading end portion 20A is floated, the leading end portion 20A is moved onto the guide surface 77 of the sheet guide 17 and smoothly guided to the path 82 along the guide surface 77.

Fourth Embodiment

Figure 10A:
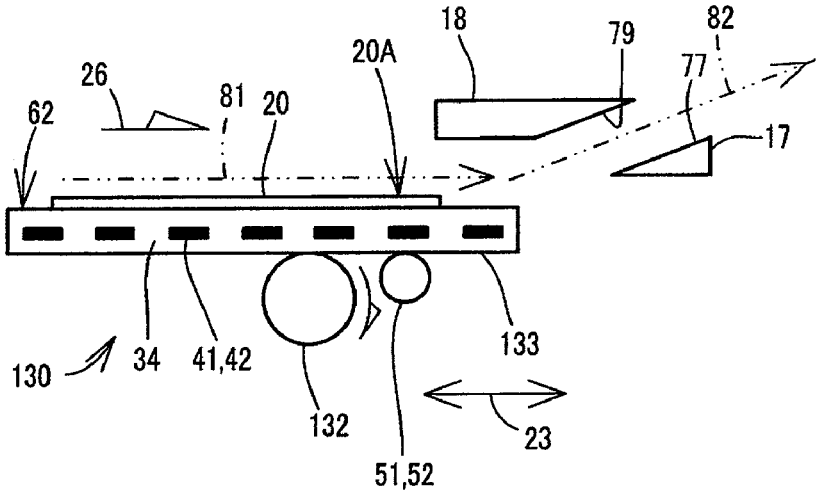
FIGS. 10A and 10B are side views of a sheet guiding apparatus 130 as a fourth embodiment of the present invention.
Figure 10B:
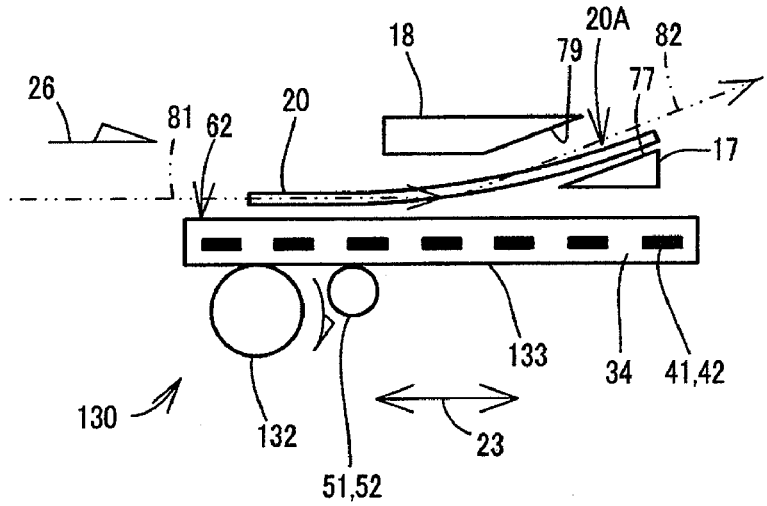

There will be next explained a fourth embodiment of the present invention with reference to FIGS. 10A and 10B. FIGS. 10A and 10B are side views of a sheet guiding apparatus 130 as the fourth embodiment of the present invention.

The sheet guiding apparatus 130 as the fourth embodiment is different from the sheet guiding apparatus 10 as the above-described first embodiment in points that a supporting board 133 having a plate-like shape is used as a supporting member instead of the rotational belt 33 and that a drive roller 132 which drives the supporting board 133 is provided instead of the belt driving device 13. The drive roller 132 is rotatably supported while being held in contact with a back surface of the supporting board 133. The supporting board 133 includes the base 34 formed of the dielectric material and the electrodes 41, 42 buried in the base 34. The electrode pattern of the electrodes 41, 42 are the same as that in the above-described rotational belt 33. The electrode rollers 51, 52 are provided on the back surface of the supporting board 133. It is noted that the electrode rollers 51, 52 are used in the present embodiment, but the leads 55, 56 may be directly connected to the respective electrodes 41, 42 without using the electrode rollers 51, 52.

An upper surface of the supporting board 133 is the sheet supporting surface 62. Where the sheet 20 is placed on the sheet supporting surface 62 in a state in which the predetermined voltages are applied to the electrodes 41, 42, the sheet 20 is adsorbed to the sheet supporting surface 62. In this state, when the drive roller 132 is driven to be rotated by, e.g., a motor, the supporting board 133 is moved in the sheet feeding direction 26 with the sheet 20 with reference to FIG. 10A. In the sheet guiding apparatus 130 as the present embodiment, where the respective voltages applied to the electrodes 41, 42 are inverted when the leading end portion 20A of the sheet 20 has reached the position located on the slightly upstream side of the sheet guide 17, as shown in FIG. 10B, the sheet 20 is floated from the sheet supporting surface 62, and the leading end portion 20A is guided toward the path 82 by the guide surface 77. It is noted that when the sheet 20 is completely guided to the path 82, the drive roller 132 is driven to be reversely rotated so as to move the supporting board 133 to a position at which the next sheet can be placed.

Figure 11A:
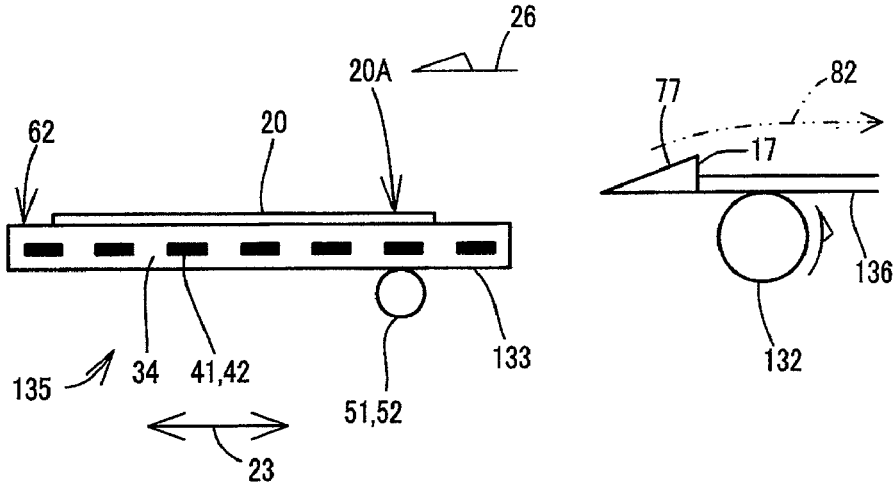
FIGS. 11A and 11B are side views of a sheet guiding apparatus 135 as a modification of the fourth embodiment of the present invention.
Figure 11B:
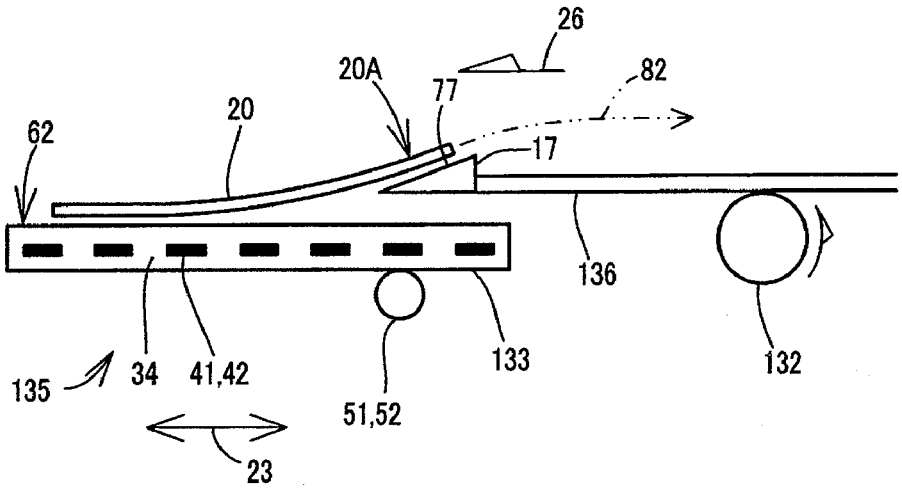

Further, as shown in FIGS. 11A and 11B, the present invention may be embodied by a sheet guiding apparatus 135 configured such that the supporting board 133 is fixed, and the sheet guide 17 is moved. FIGS. 11A and 11B are side views of the sheet guiding apparatus 135 as a modification of the fourth embodiment of the present invention.

In the sheet guiding apparatus 135 as this modification, the supporting board 133 is fixed to the frame, not shown. The sheet guide 17 is provided with a transmitting portion 136 to which a drive force of the drive roller 132 is transmitted. The drive roller 132 is rotatably supported while being supported by a back surface of the transmitting portion 136.

With reference to FIG. 11A, where the sheet 20 is placed on the sheet supporting surface 62 in a state in which the predetermined voltages are applied to the electrodes 41, 42, the sheet 20 is adsorbed to the sheet supporting surface 62. When the drive roller 132 is driven to be rotated by e.g., a motor, the sheet guide 17 is moved toward the leading end portion 20A of the sheet 20. When the leading end portion 20A has relatively reached a vicinity of the sheet guide 17, the respective voltages applied to the electrodes 41, 42 are inverted. As a result, the sheet 20 is floated from the sheet supporting surface 62. In this time, the sheet guide 17 is moved into a space between the floated leading end portion 20A and the sheet supporting surface 62, the leading end portion 20A is peeled from the sheet supporting surface 62 to be moved onto the guide surface 77. When the leading end portion 20A is peeled by the sheet guide 17, the sheet 20 is received a force from the guide surface 77 in a direction in which the sheet 20 is peeled. Thus, the sheet 20 is guided toward the path 82 along the guide surface 77 while being sequentially peeled from a side of the leading end portion 20A.

Other Embodiments

Figure 12:
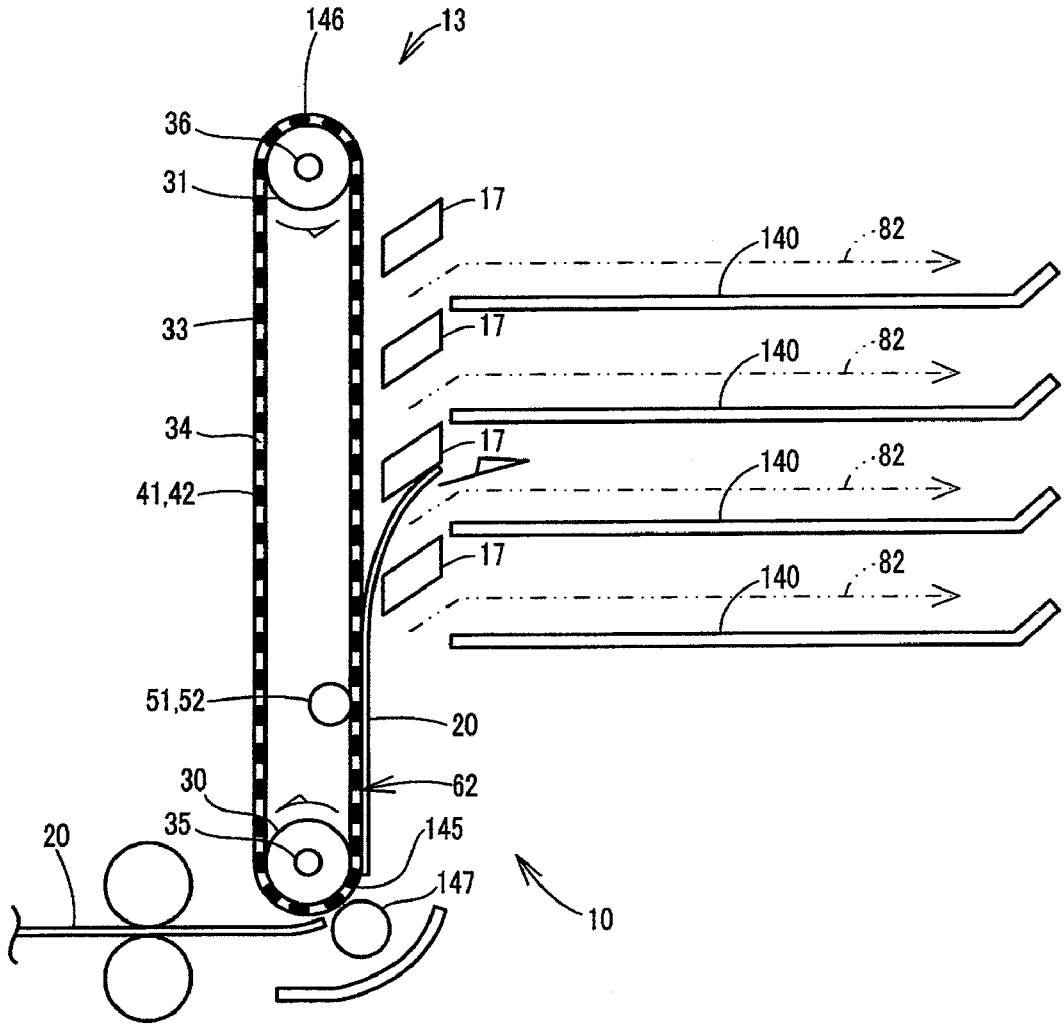
FIG. 12 is a side view showing a construction in which sheet-discharge trays 140 are respectively provided in paths 82.
Figure 13:
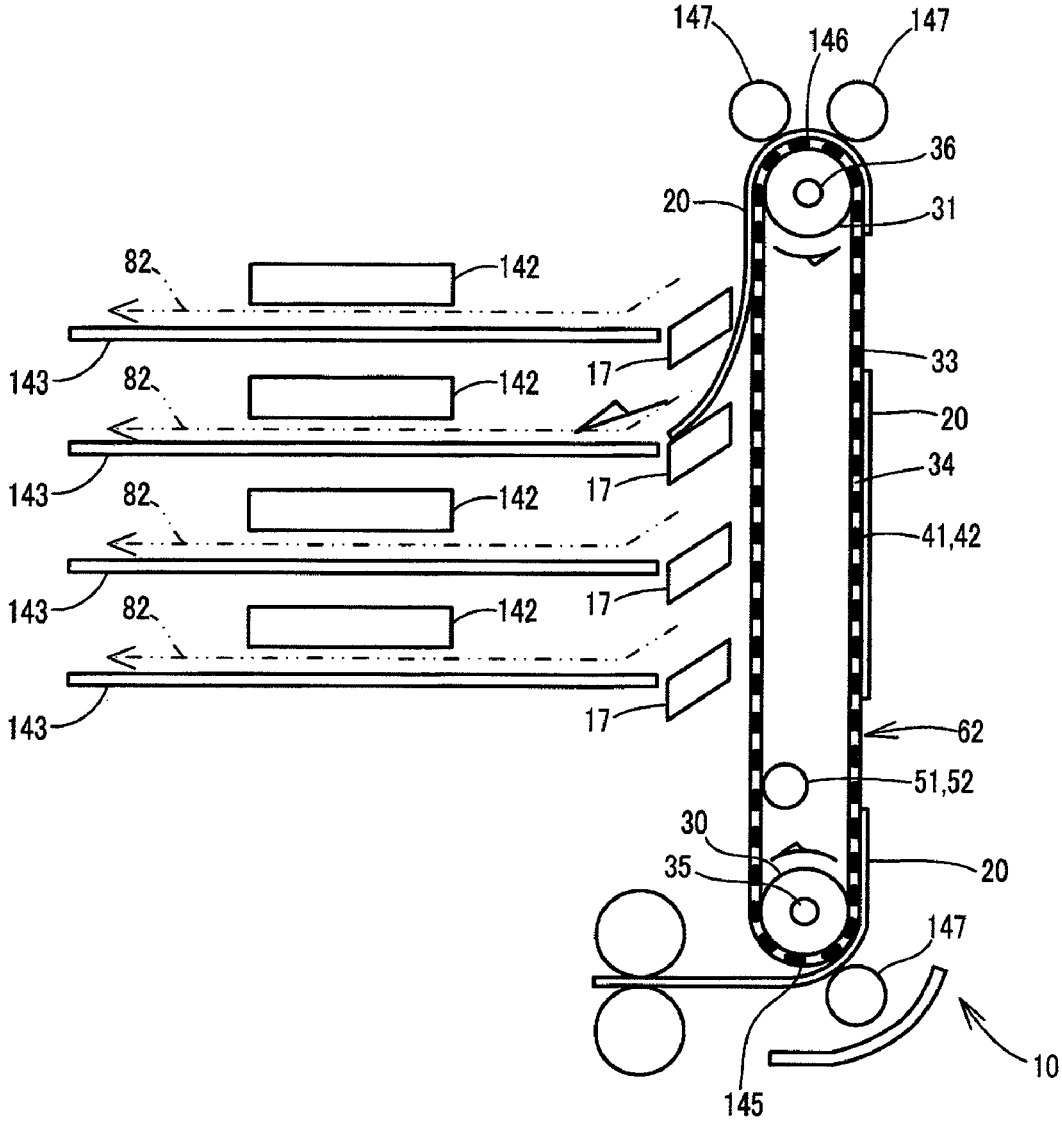
FIG. 13 is a side view showing a construction in which image recording units 142 and platens 143 are provided in the respective paths 82.

It is noted that, in the above-described embodiments, there has been explained examples in which the rotational belt 33 and the supporting board 133 are provided such that the sheet supporting surface 62 becomes horizontal, but the present invention is not limited to a mechanism in which the sheet supporting surface 62 is horizontal. For example, as shown in FIGS. 12 and 13, the belt driving device 13 and so on may be disposed such that the sheet supporting surface 62 of the rotational belt 33 is vertical. Even where the sheet supporting surface 62 is made vertical as thus described, since the sheet 20 is adsorbed to the sheet supporting surface 62 by the attractive force of the static electricity, the sheet 20 never falls. It is noted that the sheet supporting surface 62 may be inclined at the predetermined angle with respect to the horizontal plane.

Further, as shown in FIG. 12, a sheet-discharge tray (a discharging portion) 140 onto which the sheet 20 is discharged may be provided for each of the plurality of the paths 82 branched from the path 81. In this configuration, the sheet 20 can be discharged onto a desired one of the sheet-discharge trays 140. It is noted that, in this case, the sheet 20 is fed in a state in which the sheet 20 is adsorbed not only to the sheet supporting surface 62 of the rotational belt 33 but also to a curved surface 145 of a lower end portion of the rotational belt 33. In this configuration, it is preferable to provide a driven roller 147 at a position facing to the curved surface 145 so as to prevent the sheet 20 from being peeled owing to an effect of a curvature of the curved surface 145. This driven roller 147 has a construction similar to that of the driven roller 39 in the first embodiment, and is supported by, e.g., a frame by means of a shaft in a state in which the driven roller 147 is held in pressing contact with the curved surface 145 by an elastic member, not shown.

Further, as shown in FIG. 13, an image recording unit (an image recording portion) 142 and a platen 143 may be provided for each of the plurality of the paths 82 branched from the path 81. In this configuration, the sheet 20 can be discharged onto a desired one of the platens 143 to perform image recording on the sheet 20 by a desired one of the image recording unit 142 which corresponds to the platen 143. It is noted that, in this case, the sheet 20 is fed in a state in which the sheet 20 is adsorbed not only to the sheet supporting surface 62 of the rotational belt 33 but also to the curved surface 145 of the lower end portion of the rotational belt 33 and a curved surface 146 of an upper end of the rotational belt 33. Thus, in this configuration, it is preferable to provide, also at a position facing to the curved surface 146, the driven roller(s) 147 whose number is set according to a curvature of the curved surface 146, so as to prevent the sheet 20 from being peeled at the curved surface 146. It is noted that, in the above-described embodiments, to the electrode 41 and the electrode 42 is applied such a voltage that the leading end portion 20A of the sheet 20 is floated beyond the distance D between the sheet guide 17 and the sheet supporting surface 62, but the present invention is not limited to this configuration. For example, a voltage +X1(V) and the voltage 0(V) may be respectively applied to the electrode 41 and the electrode 42 ($0<X1<X$). In this case, the leading end portion 20A of the sheet 20 may not be floated beyond the distance D only by the repulsion due to the static electricity. However, since the sheet 20 is moved by the belt driving device 13, the sheet 20 receives a force in a direction away from the sheet supporting surface 62 by air resistance caused when the sheet 20 is moved in the sheet feeding direction 26. Thus, the present invention can be embodied by a sheet guiding apparatus configured such that the sheet 20 is guided to the sheet guide 17 by both of the repulsion due to the static electricity and the force applied to the sheet 20 when the sheet 20 is moved.

What is claimed is:

1. A sheet guiding apparatus, comprising:

a supporting member formed of a dielectric material having a supporting surface which supports a sheet;

a first electrode provided in the supporting member so as to be distant from the supporting surface;

an electric field generating portion configured to generate an electric field between the supporting surface and the first electrode by applying a voltage to the first electrode;

a guide member which is distant from the supporting surface by a predetermined distance in a direction perpendicular to the supporting surface and which defines a path extending to the predetermined position;

a moving portion configured to move the sheet supported by the supporting surface by moving at least one of the supporting member and the guide member relatively to each other in a direction parallel to the supporting surface; and an electric field inverting portion configured to invert a direction of the electric field generated by the electric field generating portion, before a leading end portion of the sheet has moved in a direction in which the sheet is moved to reach the guide member.

2. The sheet guiding apparatus according to claim 1, wherein the first electrode is constituted by a plurality of electrodes disposed in the direction in which the sheet is moved, the plurality of electrodes being insulated from each other, wherein the electric field generating portion generates the electric field between each of the plurality of electrodes and the supporting surface, and wherein the electric field inverting portion inverts the direction of the electric field at one of the plurality of electrodes that corresponds to a portion of the supporting surface by which the leading end portion of the sheet is supported before the leading end portion of the sheet has reached between (a) the guide member and (b) the portion of the supporting surface.

3. The sheet guiding apparatus according to claim 1, wherein the electric field inverting portion includes a switching portion configured to change a value of the voltage applied to the first electrode by the electric field generating portion, before the leading end portion of the sheet has reached the guide member.

4. The sheet guiding apparatus according to claim 3, further comprising a second electrode provided in the supporting member so as to be distant from the supporting surface of the supporting member, wherein the switching portion changes the voltage applied to the first electrode to be applied to the second electrode, and changes a voltage applied to the second electrode to be applied to the first electrode.

5. The sheet guiding apparatus according to claim 4, wherein the first electrode and the second electrode are alternately disposed in the direction in which the sheet is moved by the moving portion, and wherein the electric field generating portion causes a potential difference between the first electrode and the second electrode.

6. The sheet guiding apparatus according to claim 5, wherein the first electrode includes (a) a first connecting portion extending in a direction along the direction in which the sheet is moved and (b) a plurality of first branched portions extending from the first connecting portion in a direction perpendicular to the direction in which the sheet is moved, wherein the second electrode includes (a) a second connecting portion extending in the direction along the direction in which the sheet is moved and (b) a plurality of second branched portions extending from the second connecting portion in the direction perpendicular to the direction in which the sheet is moved, and wherein the first and second branched portions are alternately arranged along the direction in which the sheet is moved.

7. The sheet guiding apparatus according to claim 1, wherein the supporting surface is continuous, and wherein the supporting member is a rotatable member having the supporting surface.

8. The sheet guiding apparatus according to claim 7, wherein the rotatable member is a rotational belt rotatably provided so as to be hanged on at least two rotation supporting portions, wherein the supporting surface is formed on an outer surface of the rotational belt.

9. The sheet guiding apparatus according to claim 1, wherein an intensity of the electric field generated by the electric field generating portion is equal to or higher than that required for causing the leading end portion of the sheet to be distant from the supporting surface by more than the predetermined distance.

10. The sheet guiding apparatus according to claim 1, further comprising a pressing portion configured to press the sheet onto the supporting surface, wherein when the electric field inverting portion inverts the direction of the electric field, the pressing portion is disposed at a position at which a portion of the sheet other than the leading end portion thereof is pressed onto the supporting surface.

11. The sheet guiding apparatus according to claim 1, further comprising (a) a main path formed along the supporting surface and (b) a branched path branched from at least one branch point set on the main path, wherein the guide member is provided at the branch point, and wherein the moving portion moves the supporting member along the main path by applying a drive force to the supporting member, in a state in which a distance between the supporting surface and the guide member is kept at the predetermined distance.

12. The sheet guiding apparatus according to claim 11, comprising:

a plurality of branched paths each as the branched path and respectively branched from a plurality of branch points set on the main path; and a plurality of guide members each as the guide member and respectively provided at positions corresponding to the respective branch points, wherein the electric field inverting portion inverts the direction of the electric field generated by the electric field generating portion, before the leading end portion of the sheet has reached one of the plurality of guide members.

13. The sheet guiding apparatus according to claim 12, further comprising a discharging portion which is provided on at least one of the plurality of branched paths and to which the sheet is discharged.

14. The sheet guiding apparatus according to claim 12, further comprising an image recording portion which is provided on at least one of the plurality of branched paths and which records an image on the sheet.

15. A sheet guiding apparatus, comprising:

a supporting member formed of a dielectric material having a supporting surface which supports a sheet;

a first electrode provided in the supporting member, the first electrode being distant from the supporting surface;

a charge generating portion configured to charge the supporting surface by applying a voltage to the first electrode;

a guide member which is distant from the supporting surface by a predetermined distance in a direction perpendicular to the supporting surface and which defines a path extending to the predetermined position;

a moving portion configured to move the sheet supported by the supporting surface by moving at least one of the supporting member and the guide member relatively to each other in a direction parallel to the supporting surface; and a charge inverting portion configured to invert positive and negative values of a charge generated on the supporting surface by the charge generating portion, before a leading end portion of the sheet is moved in a direction in which the sheet is moved to reach the guide member.

16. The sheet guiding apparatus according to claim 15, wherein the first electrode is constituted by a plurality of electrodes disposed in the direction in which the sheet is moved, the plurality of electrodes being insulated from each other, wherein the charge generating portion charges portions of the supporting surface which respectively correspond the plurality of electrodes, and wherein the charge inverting portion inverts the positive and negative values of the charge generated on a portion of the supporting surface by which the leading end portion of the sheet is supported before the leading end portion of the sheet has reached the guide member.

17. The sheet guiding apparatus according to claim 15, wherein the charge inverting portion includes a switching portion configured to change a value of the voltage applied to the first electrode by the charge generating portion, before the leading end portion of the sheet has reached the guide member.

18. The sheet guiding apparatus according to claim 17, further comprising a second electrode provided in the supporting member so as to be distant from the supporting surface of the supporting member, wherein the switching portion changes the voltage applied to the first electrode to be applied to the second electrode, and changes a voltage applied to the second electrode to be applied to the first electrode.

19. The sheet guiding apparatus according to claim 18, wherein the first electrode and the second electrode are alternately disposed in the direction in which the sheet is moved by the moving portion, and wherein the charge generating portion charges the first electrode and the second electrode by causing a potential difference between the first electrode and the second electrode.

20. The sheet guiding apparatus according to claim 19, wherein the first electrode includes (a) a first connecting portion extending in a direction along the direction in which the sheet is moved and (b) a plurality of first branched portions extending from the first connecting portion in a direction perpendicular to the direction in which the sheet is moved, wherein the second electrode includes (a) a second connecting portion extending in the direction along the direction in which the sheet is moved and (b) a plurality of second branched portions extending from the second connecting portion in the direction perpendicular to the direction in which the sheet is moved, and wherein the first and second branched portions are alternately arranged along the direction in which the sheet is moved.

21. The sheet guiding apparatus according to claim 15, wherein an amount of the charge formed on the supporting surface charged by the charge generating portion is equal to or more than that required for causing the leading end portion of the sheet to be distant from the supporting surface by more than the predetermined distance.

22. The sheet guiding apparatus according to claim 15, further comprising a pressing portion configured to press the sheet onto the supporting surface, wherein when the charge inverting portion inverts the positive and negative values of the charge generated on the supporting surface, the pressing portion is disposed at a position at which a portion of the sheet other than the leading end portion thereof is pressed onto the supporting surface.

* * * * *